US007188982B2

(12) United States Patent
Kato et al.

(10) Patent No.: US 7,188,982 B2
(45) Date of Patent: Mar. 13, 2007

(54) VEHICLE HEADLAMP, REFLECTOR FOR THE VEHICLE HEADLAMP, COMPUTER PROGRAM FOR DESIGNING THE REFLECTOR

(75) Inventors: Yoshiki Kato, Isehara (JP); Tatsuya Hoshi, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 90 days.

(21) Appl. No.: 10/725,337

(22) Filed: Dec. 2, 2003

(65) Prior Publication Data

US 2004/0160785 A1 Aug. 19, 2004

(30) Foreign Application Priority Data

Dec. 2, 2002 (JP) ..... 2002-349866

(51) Int. Cl.
*F21V 7/00* (2006.01)

(52) U.S. Cl. ..... 362/518; 362/507; 362/522; 362/538

(58) Field of Classification Search ..... 362/518, 362/522, 539, 538, 519, 507
See application file for complete search history.

(56) References Cited

U.S. PATENT DOCUMENTS

| | | | | |
|---|---|---|---|---|
| 4,697,225 | A * | 9/1987 | Lindae et al. | 362/518 |
| 4,972,307 | A * | 11/1990 | Takatsuji et al. | 362/309 |
| 5,215,368 | A * | 6/1993 | Neumann | 362/518 |
| 5,636,917 | A | 6/1997 | Furami et al. | |
| 5,961,206 | A | 10/1999 | Eichler | |
| 6,007,223 | A * | 12/1999 | Futami | 362/517 |
| 6,554,460 | B1 * | 4/2003 | Saladin | 362/539 |
| 6,626,565 | B2 * | 9/2003 | Ishida | 362/514 |
| 6,866,408 | B1 | 3/2005 | Albou | |
| 2003/0076686 | A1 | 4/2003 | Ishida | |

FOREIGN PATENT DOCUMENTS

| | | |
|---|---|---|
| DE | 100 05 652 A1 | 8/2000 |
| EP | 0 153 485 A2 | 9/1985 |
| JP | 63-236201 A | 10/1988 |
| JP | 5-75903 U | 10/1993 |
| JP | 2003-132714 | 5/2003 |
| JP | 2003-132714 A | 5/2003 |

OTHER PUBLICATIONS

David F. Rogers, J. Alan Adams, Mathematical Elements for Computer Graphics, Second Edition, 1990, pp. 445-446.

* cited by examiner

*Primary Examiner*—Renee Luebke
*Assistant Examiner*—Gunyoung T. Lee
(74) *Attorney, Agent, or Firm*—Foley & Lardner LLP

(57) ABSTRACT

The projector type vehicle headlamp includes a light source, a reflector including a reflection surface for reflecting light from the light source, and a condenser lens that irradiates reflected light from the reflection surface forwards. The reflection surface includes a plurality of segments, and is formed of a free-form surface obtained by deforming a reference ellipsoid of revolution. The light source is arranged between a first focal point of the reference ellipsoid of revolution and the condenser lens, closer to the first focal point than to the condenser lens. Segments forming one end and other end portions of a light distribution pattern includes a wide area-illuminating reflection surface that makes the one end and the other end portions substantially a rectangular shape, where the other end portion is opposite to the one end portion with respect to a center of the light distribution pattern.

9 Claims, 15 Drawing Sheets

VEHICLE HEADLAMP, REFLECTOR FOR THE VEHICLE HEADLAMP, COMPUTER PROGRAM FOR DESIGNING THE REFLECTOR

CROSS-REFERENCE TO RELATED APPLICATIONS

The present document incorporates by reference the entire contents of Japanese priority document, 2002-349866 filed in Japan on Dec. 2, 2002.

BACKGROUND OF THE INVENTION

1) Field of the Invention

The present invention relates to a projector type vehicle headlamp, a reflector of the projector type vehicle headlamp, and a computer program for designing the reflector.

2) Description of the Related Art

This type of projector type vehicle headlamp and a design method is described in, for example, Japanese Patent Application Laid-Open No. P2003-132714A.

The projector type vehicle headlamp includes a projection lens 5, a reflecting mirror 3 having the first focal position F1 and the second focal position F2, a light source 2 whose light emitting section is located at the first focal position F1, and a shading member 4 whose upper edge is located near the second focal position F2. When the light source 2 is turned on, light from a light emitting section in the light source 2 is reflected by the reflecting mirror 3. The reflected light passes through the shading member 4 and irradiated forwards from the projection lens 5. The irradiated light illuminates the road surface, people on the road (pedestrians), and objects (a vehicle in front, oncoming vehicles, traffic signs, and buildings) by a predetermined light distribution pattern. The right and left ends of the light distribution pattern are to illuminate the traveling direction at the time of cornering (when a vehicle turns at a curve, an intersection, or a corner).

The design method of the projector type vehicle headlamp is for setting a position of the shading member 4 and the light source 2 so that the lighting efficiency of luminous flux becomes the best, with respect to the setting of the vertical width of the lighting fixture.

The examples of these types of projector type vehicle headlamps include a projector type two-light vehicle headlamp, a projector type four-light vehicle headlamp, and a projector type fog lamp.

However, since the projector type vehicle headlamp and the design method are for setting the position of the shading member 4 and the light source 2 so that the lighting efficiency of the luminous flux becomes the best, with respect to the setting of the vertical width of the lighting fixture, improvement of the visibility in the traveling direction at the time of cornering is not taken into consideration. Hence, there is a problem in improving the visibility in the traveling direction at the time of cornering.

SUMMARY OF THE INVENTION

It is an object of the present invention to solve at least the problems in the conventional technology.

The projector type vehicle headlamp according to one aspect of the present invention includes a light source, a reflector including a reflection surface for reflecting light from the light source, and a condenser lens that irradiates reflected light from the reflection surface forwards. The reflection surface includes a plurality of segments, and is formed of a free-form surface obtained by deforming a reference ellipsoid of revolution. The light source is arranged between a first focal point of the reference ellipsoid of revolution and the condenser lens, closer to the first focal point than to the condenser lens. Segments forming one end and other end portions of a light distribution pattern include a wide area-illuminating reflection surface that makes the one end and the other end portions substantially a rectangular shape, where the other end portion is opposite to the one end portion with respect to a center of the light distribution pattern.

The reflector for a projector type vehicle headlamp, according to another aspect of the present invention, includes a reflection surface that reflects light from a light source toward a condenser lens. The reflection surface includes a plurality of segments, and is formed of a free-form surface obtained by deforming a reference ellipsoid of revolution. The light source is arranged between a first focal point of the reference ellipsoid of revolution and the condenser lens, closer to the first focal point than to the condenser lens. Segments forming one end and other end portion of a light distribution pattern include a wide area-illuminating reflection surface that makes the one end and the other end portions substantially a rectangular shape, where the other end portion is opposite to the one end portion with respect to a center of the light distribution pattern.

The computer program for designing a reflector for a projector type vehicle headlamp, according to still another aspect of the present invention, makes a computer execute steps of determining, based on size data of a reference reflector input, a reference box with a front side being open, defining, from a quadratic equation for a rational B-spline surface, a reference ellipsoid of revolution that is fit in the reference box, determining control points of the reference box, setting, based on position data of the light source input, a position of a light source between a first focal point of the reference ellipsoid of revolution and a condenser lens, closer to the first focal point than to the condenser lens, deforming the reference ellipsoid of revolution by stretching the reference ellipsoid of revolution in one direction and pushing down the reference ellipsoid of revolution in other direction perpendicular to the one direction by shifting, based on shift data input, the control points of the reference box, and setting a weight of the control point that is involved in a control of one end and other end portions of a light distribution pattern obtained by a reflection surface of the ellipsoid of revolution deformed to be smaller than a value used when defining the ellipsoid of revolution to provide a wide area-illuminating reflection surface, which forms the one end and the other end portions substantially in a rectangular shape, on the reflection surface, where the other end portion is opposite to the one end portion with respect to a center of the light distribution pattern.

The computer program for designing a reflector for a projector type vehicle headlamp, according to still another aspect of the present invention makes a computer execute steps of determining, based on size data of a reference reflector input, a reference box with a front side being open, defining, from a quadratic equation for a rational B-spline surface, a reference ellipsoid of revolution that is fit in the reference box, determining control points of the reference box, setting, based on position data of the light source input, a position of a light source between a first focal point of the reference ellipsoid of revolution and a condenser lens, closer to the first focal point than to the condenser lens, deforming the reference ellipsoid of revolution by stretching the reference ellipsoid of revolution in one direction and pushing down the reference ellipsoid of revolution in other direction perpendicular to the one direction by shifting, based on first shift data input, the control points of the reference box, setting a weight of the control point that is involved in a control of one end and other end portions of a light distribution pattern obtained by a reflection surface of the ellipsoid of revolution deformed to be smaller than a value used when defining the ellipsoid of revolution to provide a wide area-illuminating reflection surface, which forms the one end and the other end portions substantially in a rectangular shape, on the reflection surface, where the other end portion is opposite to the one end portion with respect to a center of the light distribution pattern, increasing, based on increase data input, number of the control points, and controlling locally the wide area-illuminating reflection surface by shifting, based on second shift data input, the control points increased to form a diffuse reflection surface, which diffuses the one end and the other end portions formed substantially in a rectangular shape by the wide area-illuminating reflection surface to far sides from the center, respectively, on the reflection surface.

The computer program for designing a reflector for a projector type vehicle headlamp, according to still another aspect of the present invention makes a computer execute steps of determining, based on size data of a reference reflector input, a reference box with a front side being open, defining, from a quadratic equation for a rational B-spline surface, a reference ellipsoid of revolution that is fit in the reference box, determining control points of the reference box, setting, based on position data of the light source input, a position of a light source between a first focal point of the reference ellipsoid of revolution and a condenser lens, closer to the first focal point than to the condenser lens, deforming the reference ellipsoid of revolution by stretching the reference ellipsoid of revolution in one direction and pushing down the reference ellipsoid of revolution in other direction perpendicular to the one direction by shifting, based on first shift data input, the control points of the reference box, setting a weight of the control point that is involved in a control of one end and other end portions of a light distribution pattern obtained by a reflection surface of the ellipsoid of revolution deformed to be smaller than a value used when defining the ellipsoid of revolution to provide a wide area-illuminating reflection surface, which forms the one end and the other end portions substantially in a rectangular shape, on the reflection surface, wherein the other end portion is opposite to the one end portion with respect to a center of the light distribution pattern, increasing, based on increase data input, number of the control points, controlling locally the wide area-illuminating reflection surface by shifting, based on second shift data input, the control points increased to form a diffuse reflection surface, which diffuses the one end and the other end portions formed substantially in a rectangular shape by the wide area-illuminating reflection surface to far sides from the center, respectively, on the reflection surface, and forming a luminous intensity-improving reflection surface, which improves luminous intensity of the one end and the other end portions formed substantially in a rectangular shape by the wide area-illuminating reflection surface and diffused by the diffuse reflection surface, on a portion of the diffuse reflection surface where light from a light source is not effectively used when a predetermined light distribution pattern for low beam is formed.

The other objects, features and advantages of the present invention are specifically set forth in or will become apparent from the following detailed descriptions of the invention when read in conjunction with the accompanying drawings.

DETAILED DESCRIPTION

Figure 1:
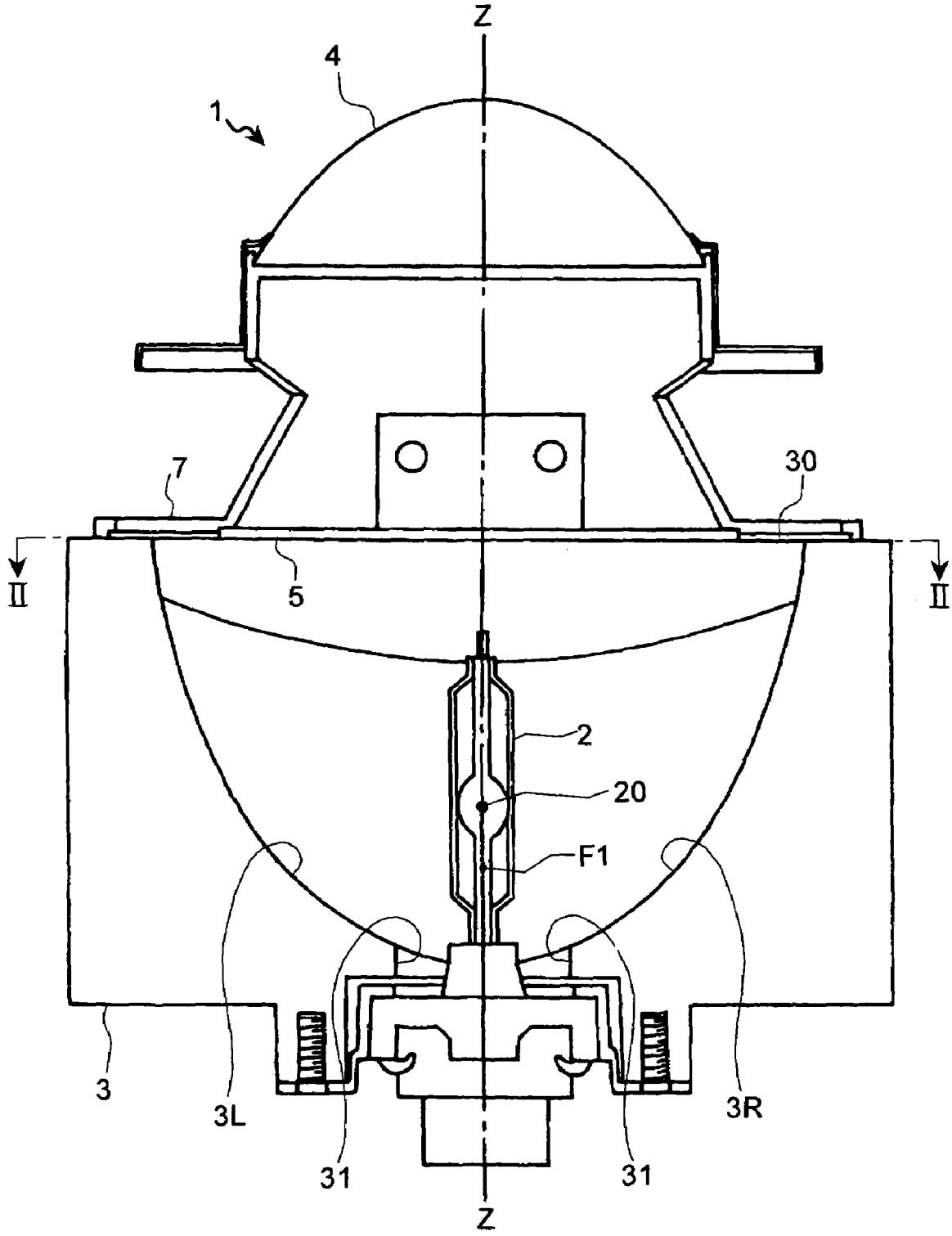
FIG. 1 is a cross section of a projector type vehicle headlamp and a reflector according to a first embodiment of the present invention.

Three embodiments of the projector type vehicle headlamp and the reflector in the projector type vehicle headlamp, and one embodiment of the reflector design program in the projector type vehicle headlamp according to the present invention will be explained with reference to the accompanying drawings. However, the present invention is not limited by these embodiments.

In the figure, the reference numeral "U" indicates upward as seen from the driver side. The reference numeral "D" indicates downward as seen from the driver side. The reference numeral "L" indicates the left side when the driver sees the front. The reference numeral "R" indicates the right side when the driver sees the front. In the drawings (FIGS. 3 to 7, FIG. 10 to 12, FIG. 14 to 18, FIGS. 21, 29, and 31) of the light distribution pattern in the accompanying drawings, the reference numeral "HL-HR" indicates a horizontal line on the screen. The reference numeral "VU-VD" indicates a vertical line on the screen. Further, in the diagram illustrating the light distribution pattern in the accompanying drawings, the first measure indicates 5 degrees.

The light distribution pattern in the accompanying drawings is the light distribution pattern obtained by computer simulation. In other words, the light distribution pattern in the accompanying drawings is created by computer simulation so that the light distribution pattern irradiated onto the screen 10 meters ahead from the vehicle headlamp matches with the light distribution pattern illuminating the road surface by an actual vehicle headlamp. The light distribution pattern created by the computer simulation is such that a change in luminance intensity (illuminance change) is expressed with an image visible to human eye by color distribution, for example, at a scale of 8-bit 256 gradations. In the diagram of the light distribution pattern, the change in luminance intensity is expressed by an iso-intensity curve of light.

In the diagrams of the light distribution pattern shown in FIGS. 3, 12, 21, 29, and 31, the iso-intensity curve of light at the center indicates 30000 candelas, and other curves respectively indicate 20000 candelas, 10000 candelas, 5000 candelas, 3000 candelas, 2000 candelas, 1000 candelas, and 500 candelas toward the outside. In the diagram of the light distribution pattern shown in FIGS. 4 to 7, FIGS. 10, 11, 14, 17, and 18, the iso-intensity curve of light at the center indicates 10000 candelas, and other curves respectively indicate 5000 candelas, 3000 candelas, 2000 candelas, 1000 candelas, and 500 candelas toward the outside. Further, in the diagram of the light distribution pattern shown in FIGS. 15 and 16, the iso-intensity curve of light at the center indicates 3000 candelas, and other curves respectively indicate 2000 candelas, 1000 candelas, and 500 candelas toward the outside.

FIGS. 1 to 7 are for illustrating a vehicle headlamp and a reflector according to a first embodiment of the present invention.

In these figures, the reference numeral 1 denotes a normal projector type two-light vehicle headlamp (a vehicle headlamp). The vehicle headlamp 1 comprises a discharge lamp 2 as a light source, a reflector 3, a condenser lens (projector lens) 4, a shade 5, and a switching unit (not shown).

The discharge lamp 2 is a high-pressure metal vapor discharge lamp such as a so-called metal halide lamp, a high intensity discharge lamp (HID), and the like. The discharge lamp 2 is detachably attached to the reflector 3. A light emitting section 20 of the discharge lamp 2 is located on the front side (on the condenser lens 4 side) of a first focal point F1 of a reference ellipsoid of revolution 200 (see FIGS. 24 to 26, and FIG. 28) described later of the reflector 3.

Reflection surfaces (3U, 3D, 3L, 3R) are formed on the inner concave surface of the reflector 3, by aluminum deposition or silver painting. The reflection surfaces (3U, 3D, 3L, 3R) of the reflector 3 have a first focal point F1, a second focal point (a focal line on a horizontal section), an optical axis Z—Z, and an opening 30. The second focal point is not shown. At the center of the reflection surfaces (3U, 3D, 3L, 3R) of the reflector 3, a circular through hole 31 is provided for inserting the discharge lamp 2. The reflector 3 is secured and held by a holder (frame) 7.

Figure 3:
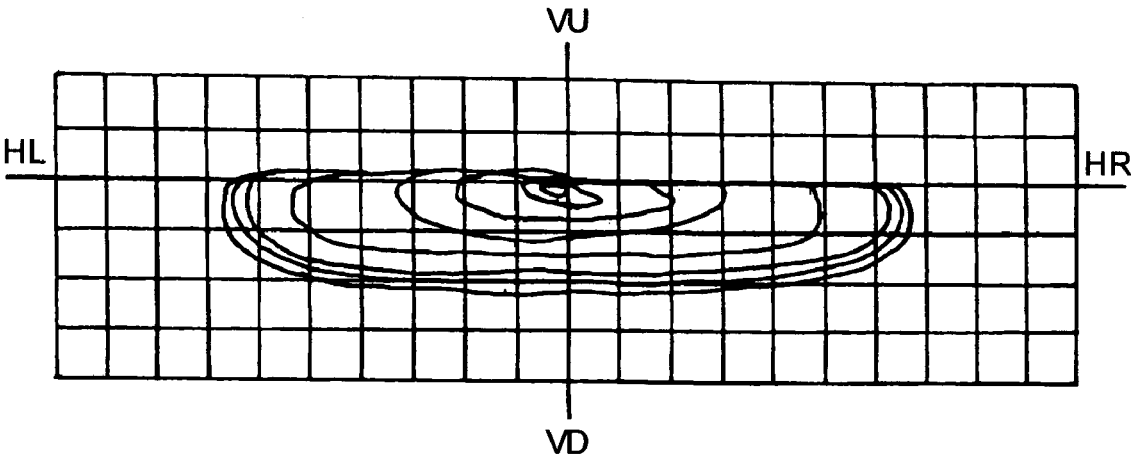
FIG. 3 is a light distribution pattern obtained by whole segments on a reflection surface.

The reflector 3 is generally manufactured together with the discharge lamp 2 and the condenser lens 4 based on the light distribution design. In other words, the reflection surfaces (3U, 3D, 3L, 3R) are designed so as to obtain an intended light distribution pattern for passing by (see FIG. 3), and manufactured based on this design. FIG. 3 indicates a light distribution pattern for passing by, but an intended light distribution pattern for driving can be naturally obtained from the reflection surfaces (3U, 3D, 3L, 3R) by switching the shade 5.

Figure 2:
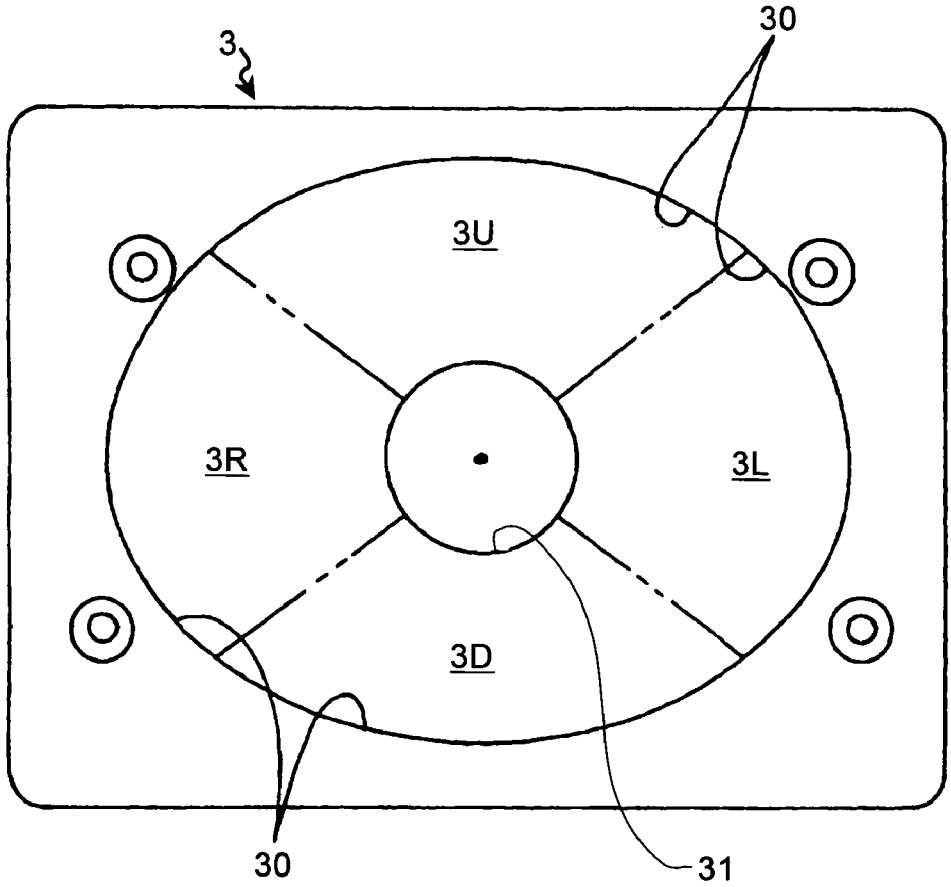
FIG. 2 is a front cross section of the projector type vehicle headlamp and the reflector cut along the line II—II in FIG. 1.
Figure 4:
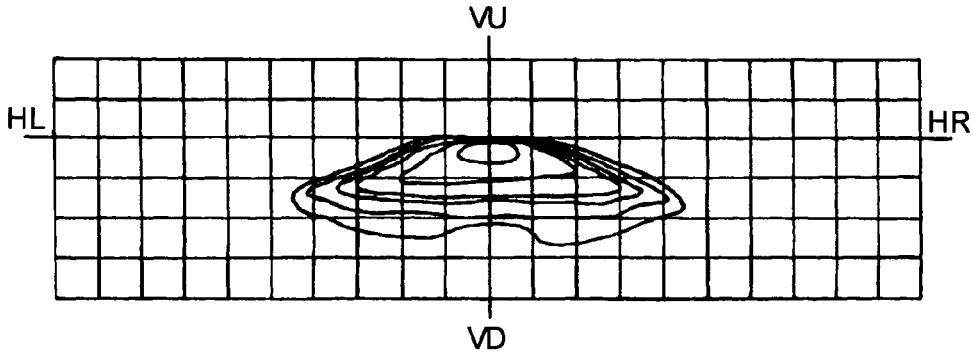
FIG. 4 is a light distribution pattern obtained by a top segment on the reflection surface.
Figure 5:
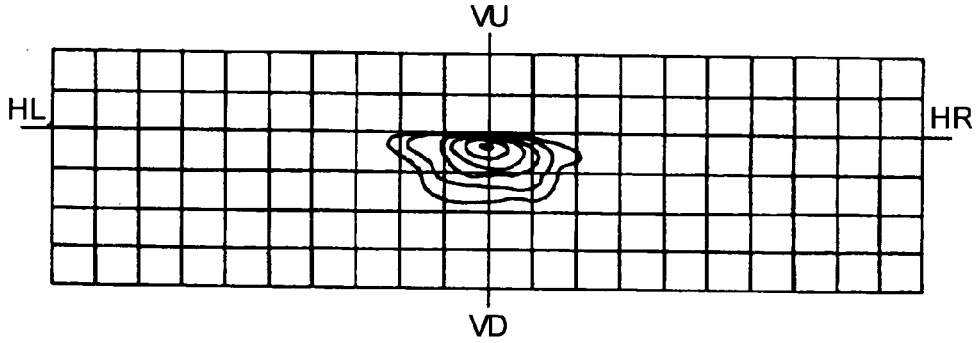
FIG. 5 is a light distribution pattern obtained by a bottom segment on the reflection surface.
Figure 6:
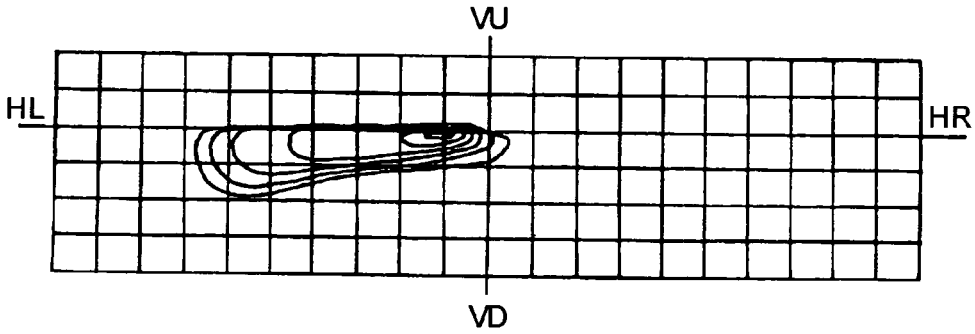
FIG. 6 is a light distribution pattern obtained by a right segment on the reflection surface.
Figure 7:
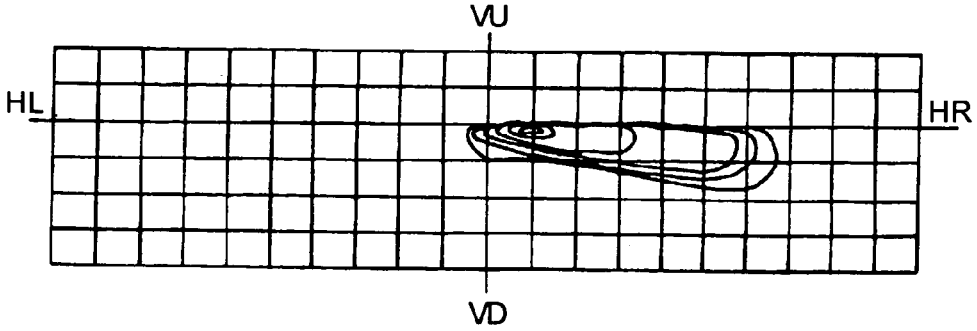
FIG. 7 is a light distribution pattern obtained by a left segment on the reflection surface.

As shown in FIG. 2, the reflection surfaces (3U, 3D, 3L, 3R) are formed of four segments 3U, 3D, 3L, and 3R divided into four vertically and laterally. The upside segment 3U of the reflection surfaces (3U, 3D, 3L, 3R) forms, as shown in FIG. 4, a portion of the diffused light at the central portion, of the light distribution pattern shown in FIG. 3. The downside segment 3D of the reflection surfaces (3U, 3D, 3L, 3R) forms, as shown in FIG. 5, a portion of the spot light at the central portion, of the light distribution pattern shown in FIG. 3. The right side segment 3R of the reflection surfaces (3U, 3D, 3L, 3R) forms, as shown in FIG. 6, a portion of the diffused light at the left end portion, which illuminates the traveling direction at the time of left side cornering, of the light distribution pattern shown in FIG. 3. Further, the left side segment 3L of the reflection surfaces (3U, 3D, 3L, 3R) forms, as shown in FIG. 7, a portion of the diffused light at the right end portion, which illuminates the traveling direction at the time of right side cornering, of the light distribution pattern shown in FIG. 3.

The reflection surfaces (3U, 3D, 3L, 3R) are formed of, as shown in FIG. 2, a free-form surface of non-uniform rational B-spline surface (NURBS), obtained by deforming a reference ellipsoid of revolution 200 described later by enlarging it horizontally and crushing it vertically (see Japanese Patent Application Laid-Open No. 2001-35215). In the segment forming the left and the right end portions of the light distribution pattern, of the four segments 3U, 3D, 3L, and 3R of the reflection surfaces (3U, 3D, 3L, 3R), the left segment 3L and the right segment 3R in this case, a wide area-illuminating reflection surface, which forms the left and the right end portions of the light distribution pattern, substantially in a rectangular shape, is respectively formed. By the wide area-illuminating reflection surfaces, the left and the right end portions of the light distribution pattern are formed substantially in a rectangular shape, as shown in FIGS. 3, 6, and 7. As a result, the wide area-illuminating reflection surface can also illuminate this side in the traveling direction at the time of cornering.

In other words, as shown in FIG. 6, the wide area-illuminating reflection surface in the right segment 3R forms the portion of the diffused light at the left end of the light distribution pattern (left diffused pattern of a 5[l x] line) substantially in a rectangular shape. Further, as shown in FIG. 7, the wide area-illuminating reflection surface in the left segment 3L forms the portion of the diffused light at the right end of the light distribution pattern (right diffused pattern of a 5[l x] line) substantially in a rectangular shape. As a result, the wide area-illuminating reflection surface in the left segment 3L and the wide area-illuminating reflection surface in right segment 3R can also illuminate this side in the traveling direction at the time of cornering.

The reflection surfaces (3U, 3D, 3L, 3R) are formed of a free-form surface of NURBS. Therefore, at the first focal point F1 and the second focal point on the reflection surfaces (3U, 3D, 3L, 3R), there is no single focal point in a strict sense, but since a difference in the focal length between a plurality of reflection surfaces is small, it can be said that substantially the same focal point is shared. Therefore, in this specification and the drawings, these are simply referred to as the first focal point and the second focal point. Likewise, on the optical axis Z—Z of the reflection surfaces (3U, 3D, 3L, 3R), there is no single optical axis in a strict sense, but since a difference in the optical axis between the reflection surfaces is small, it can be said that substantially the same optical axis is shared. Therefore, in this specification and the drawings, it is simply referred to as an optical axis.

The condenser lens 4 has a focal plane (a meridional plane) on the object space side ahead of the second focal point of the reflector 3. The focal plane on the object space side is not shown. The condenser lens 4 is secured and held on the holder 7.

The shade 5 is for switching the illuminated light from the condenser lens 4 either to a low beam by which a predetermined light distribution pattern for passing by as shown in FIG. 3 can be obtained, or to a high beam by which a predetermined light distribution pattern for driving (not shown) can be obtained. The shade 5 is arranged at the edge of the opening 30 on the reflection surfaces (3U, 3D, 3L, 3R) of the reflector 3. The reflected light reflected by the reflection surfaces (3U, 3D, 3L, 3R), being light from the discharge lamp 2, converges at the opening 30 on the reflection surfaces (3U, 3D, 3L, 3R). The switching unit is for switching the shade 5 to a low-beam position or to a high-beam position. When the shade 5 is in the low-beam position, the low beam can be obtained. When the shade 5 is in the high-beam position, the high beam can be obtained.

The vehicle headlamp 1 and the reflector 3 according to the first embodiment have the configuration described above, and the operational effect thereof will be explained below.

When the discharge lamp 2 is turned on, light from the light emitting section 20 of the discharge lamp 2 is reflected by the reflection surfaces (3U, 3D, 3L, 3R) of the reflector 3. The reflected light is irradiated forwards through the condenser lens 4. When the shade 5 is switched to the low-beam position or the high-beam position by the switching operation of the switching unit, the irradiated light is switched to the low beam or the high beam. As a result, when the irradiated light is switched to the low beam, a predetermined light distribution pattern for passing by shown in FIG. 3 can be obtained. When the irradiated light is switched to the high beam, a predetermined light distribution pattern for driving can be obtained. The vehicle headlamp 1 is formed by components manufactured based on the light distribution design, and illuminates the road surface by the predetermined light distribution pattern.

In the vehicle headlamp 1 and the reflector 3 according to the first embodiment, the wide area-illuminating reflection surfaces are formed on the left and the right segments 3L and 3R forming the left and the right end portions of the light distribution pattern, of the four segments 3U, 3D, 3L, and 3R on the reflection surfaces (3U, 3D, 3L, 3R). As shown in FIGS. 6 and 7, the wide area-illuminating reflection surfaces on the left and the right segments 3L and 3R form portions of the diffused light at the left and the right end portions of the light distribution pattern (the left and the right diffusion patterns on the 5[l x] line) substantially in a rectangular shape.

Therefore, the left and the right end portions of the light distribution pattern irradiated from the vehicle headlamp 1 and the reflector 3 according to the first embodiment are formed substantially in a rectangular shape, as shown in FIG. 3, as in the range of about 20 to 33 degrees on the left and about 5 to 10 degrees downward, and about 20 to 33 degrees on the right and about 5 to 10 degrees downward. As a result, the vehicle headlamp 1 and the reflector 3 according to the first embodiment can illuminate this side in the traveling direction at the time of cornering, thereby improving the visibility in the traveling direction at the time of cornering.

Further, in the reflector 3 according to the first embodiment, the reference ellipsoid of revolution 200 is deformed under the condition that the light emitting section 20 in the discharge lamp 2 is arranged ahead of the first focal point F1 of the reflection surfaces (3U, 3D, 3L, 3R), and the wide area-illuminating reflection surface is formed respectively in the portions of the deformed ellipsoid of revolution 200 where the left and the right end portions of the light distribution pattern are formed (the left and the right segments 3L and 3R). Therefore, the reflector 3 according to the first embodiment has a simple configuration for the reflection surfaces (3U, 3D, 3L, 3R), and hence the production cost can be reduced:

FIGS. 8 to 12 are for illustrating a vehicle headlamp and a reflector according to a second embodiment of the present invention. Like reference numerals as in FIGS. 1 to 7 refer to like parts throughout the figures.

In the vehicle headlamp and the reflector according to the second embodiment, diffuse reflection surfaces 30L and 30R are formed in the vehicle headlamp and the reflector according to the first embodiment, together with the wide area-illuminating reflection surfaces in the first embodiment. In other words, the diffuse reflection surfaces 30L and 30R that diffuse to left and right the points of the left and the right end portions of the light distribution pattern (and the left and the right end portions) formed substantially in the rectangular shape by the wide area-illuminating reflection surfaces in the first embodiment are formed together with the wide area-illuminating reflection surfaces in the left and the right segments 3L and 3R, which form the left and the right end portions of the light distribution pattern, of the four segments 3U, 3D, 3L, and 3R on the reflection surfaces (3U, 3D, 3L, 3R).

Figure 8:
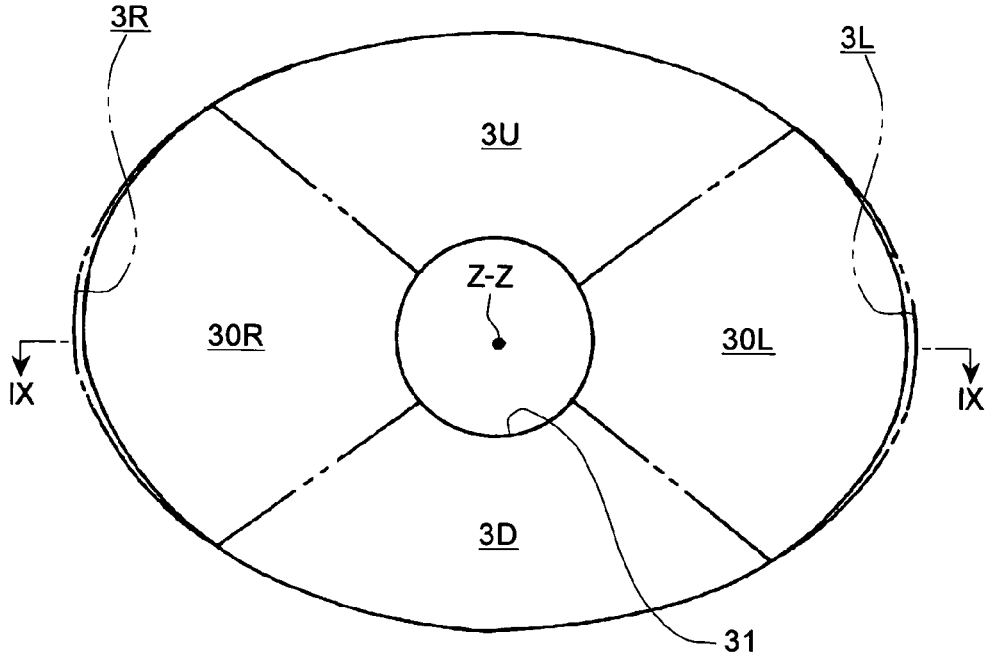
FIG. 8 is a front view of a reflector and a reflection surface of a vehicle headlamp and a reflector according to a second embodiment of the present invention.
Figure 9:
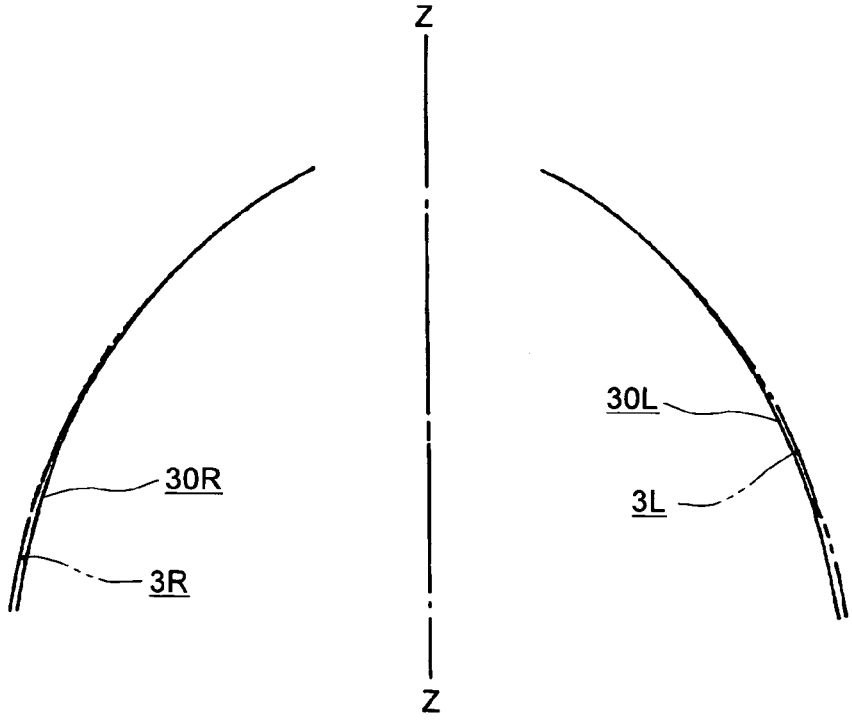
FIG. 9 is a cross section of the reflector cut along the line IX—IX in FIG. 8.
Figure 10:
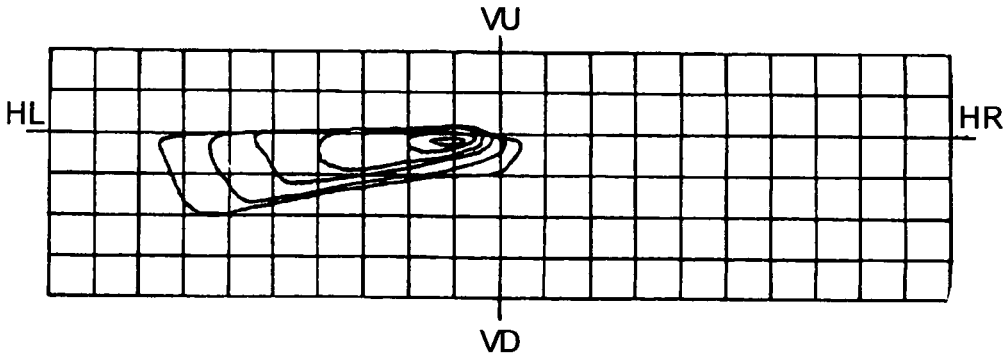
FIG. 10 is a light distribution pattern obtained by a right segment of the reflector.
Figure 11:
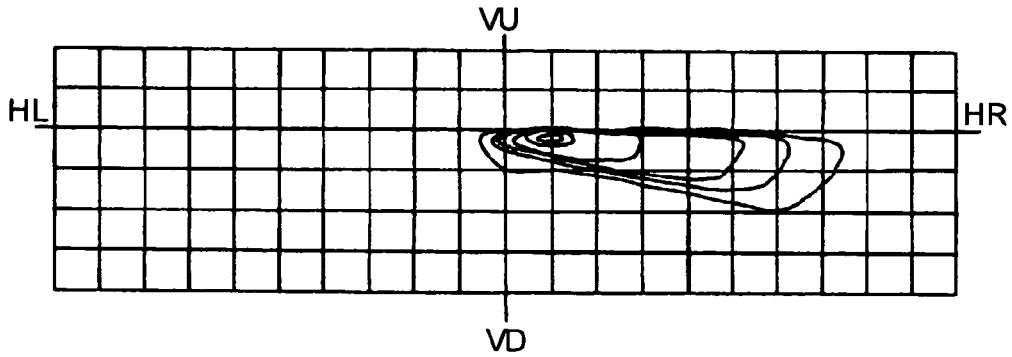
FIG. 11 is a light distribution pattern obtained by a left segment of the reflector.
Figure 12:
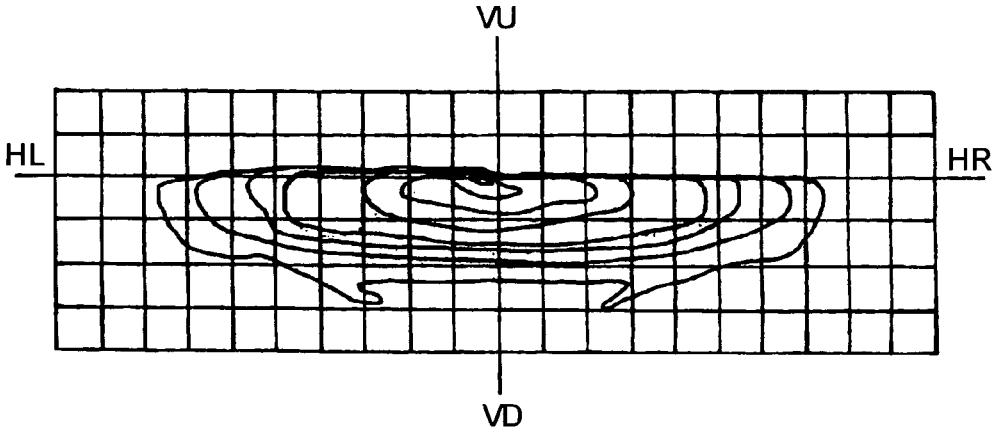
FIG. 12 is a light distribution pattern obtained by whole segments of the reflector.

The diffuse reflection surfaces 30L and 30R (shown by solid line in FIGS. 8 and 9) are arranged on the optical axis Z—Z side with respect to the wide area-illuminating reflection surfaces in the left and the right segments 3L and 3R (shown by two-dot chain line in FIGS. 8 and 9). As a result, as shown in FIGS. 10 to 12, the diffuse reflection surfaces 30L and 30R can diffuse the points of the left and the right end portions of the light distribution pattern formed substantially in the rectangular shape by the wide area-illuminating reflection surfaces, to left and right up to about 38 degrees.

Since the vehicle headlamp and the reflector according to the second embodiment have the configuration described above, the following operational effect can be achieved. That is, the left and the right end portions of the light distribution pattern irradiated from the vehicle headlamp and the reflector according to the second embodiment are formed substantially in a rectangular shape, with the top thereof diffused to left and right, as shown in FIG. 12, as the most part in the range of about 20 to 38 degrees on the left and about 5 to 10 degrees downward, and the most part in the range of about 20 to 38 degrees on the right and about 5 to 10 degrees downward. As a result, the vehicle headlamp and the reflector according to the second embodiment can illuminate this side and the other side (far side) in the traveling direction at the time of cornering, thereby improving the visibility in the traveling direction at the time of cornering.

FIGS. 13 to 21 are for illustrating a vehicle headlamp and a reflector according to a third embodiment of the present invention. Like reference numerals as in FIGS. 1 to 12 refer to like parts throughout the figures.

In the vehicle headlamp and the reflector according to the third embodiment, luminous intensity-improving reflection surfaces 31L and 31R are formed in the vehicle headlamp and the reflector according to the second embodiment, together with the wide area-illuminating reflection surfaces in the first embodiment and diffuse reflection surfaces 30L and 30R in the second embodiment. In otherwords, the luminous intensity-improving reflection surfaces 31L and 31R that improve the luminous intensity at the left and the right end portions of the light distribution pattern (and the left and the right end portions), formed substantially in a rectangular shape by the wide area-illuminating reflection surfaces, with the points thereof diffused to left and right by the diffuse reflection surfaces 30L and 30R, are formed in portions of the diffuse reflecting surfaces 30L and 30R, in which the light from the discharge lamp 2 is not effectively used when the predetermined light distribution pattern for passing by (see FIG. 12) is formed, that is, in this example, portions downward from the horizontal line, shown by one-dot chain line in FIG. 13 and indicated by the shaded portions (hereinafter, "shaded portions"). The luminous intensity-improving reflection surfaces 31L and 31R in this example will be explained below in detail.

Figure 13:
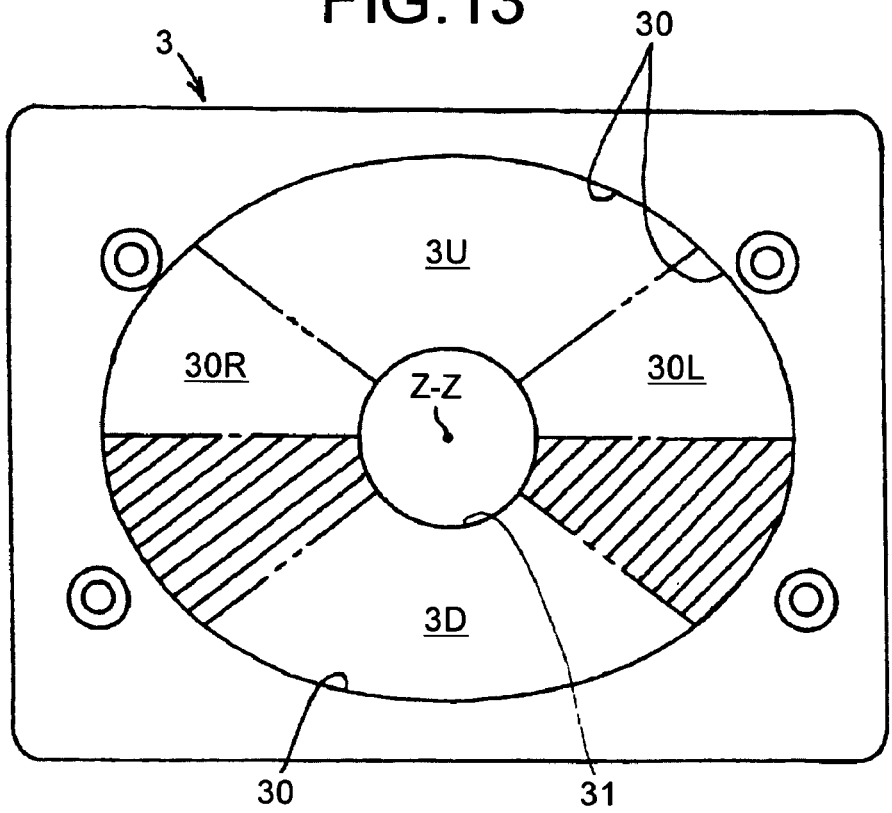
FIG. 13 is a front view of a reflector and a reflection surface of a vehicle headlamp and a reflector according to a third embodiment of the present invention.

In the vehicle headlamp and the reflector according to the third embodiment, a portion in which the light from the discharge lamp 2 is not effectively used at the time of the low beam exists in the diffuse reflection surfaces 30L and 30R in the left and the right segments, which form the left and the right end portions of the light distribution pattern, of the four segments 3U, 3D, 3L, and 3R on the reflection surfaces (3U, 3D, 3L, 3R). This portion (in which the light from the discharge lamp 2 is not effectively used at the time of the low beam) is, as shown in FIG. 13, the shaded portion on the reflection surfaces 30L and 30R.

Figure 14:
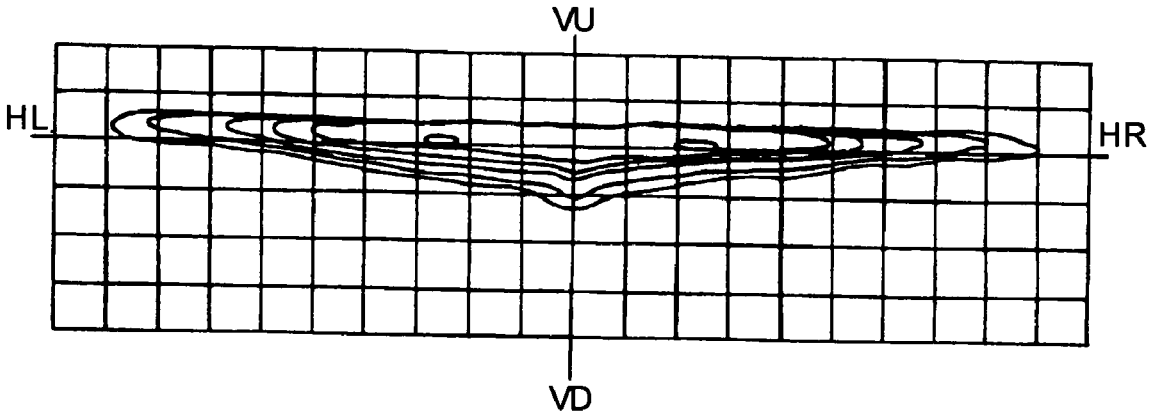
FIG. 14 is a light distribution pattern obtained in a high beam by shaded portions of a left and a right segments on the reflection surface.
Figure 15:
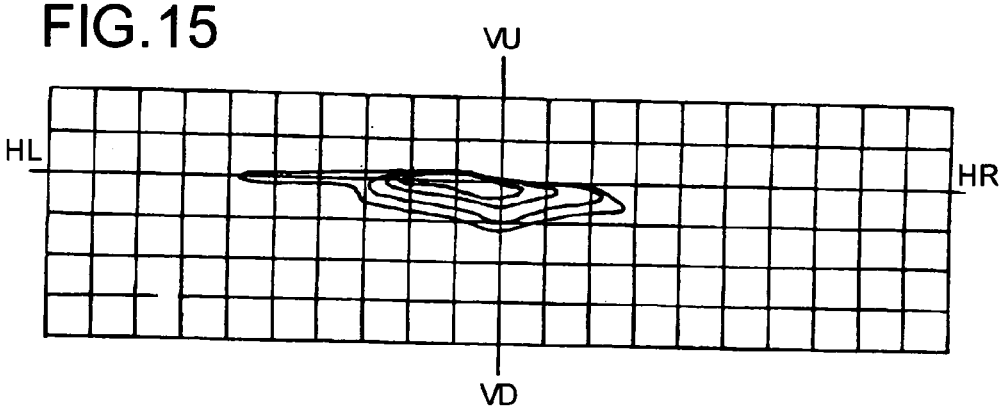
FIG. 15 is a light distribution pattern obtained in a low beam by shaded portions of a left and a right segments on the reflection surface.

In the shaded portion at the time of high beam, as shown in FIG. 14, a light distribution pattern in which the left and the right points are outstretched up to about 40 degrees is obtained. In the shaded portion at the time of low beam, as shown in FIG. 15, a light distribution pattern in which the left point is at about 28 degrees and the right point is at about 13 degrees is obtained. As is obvious from FIGS. 14 and 15, in the shaded portions, the light from the discharge lamp 2 is not effectively used at the time of low beam.

Figure 17:
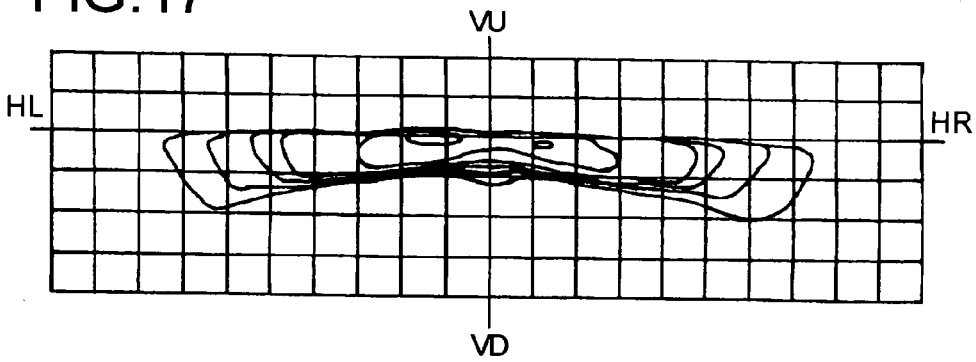
FIG. 17 is a light distribution pattern obtained by the left and the right segments (including the shaded portions) on the reflection surface at the time of the low beam.

Therefore, as shown in FIG. 17, the left and the right end portions in the 5000-candela zone of the light distribution pattern obtained by the diffuse reflection surfaces 30L and 30R at the time of low beam are located closely to both the left and the right sides at about 15 degrees. Therefore, sufficient luminous intensity (illuminance) is not obtained at the left and the right end portions of the light distribution pattern.

Figure 19:
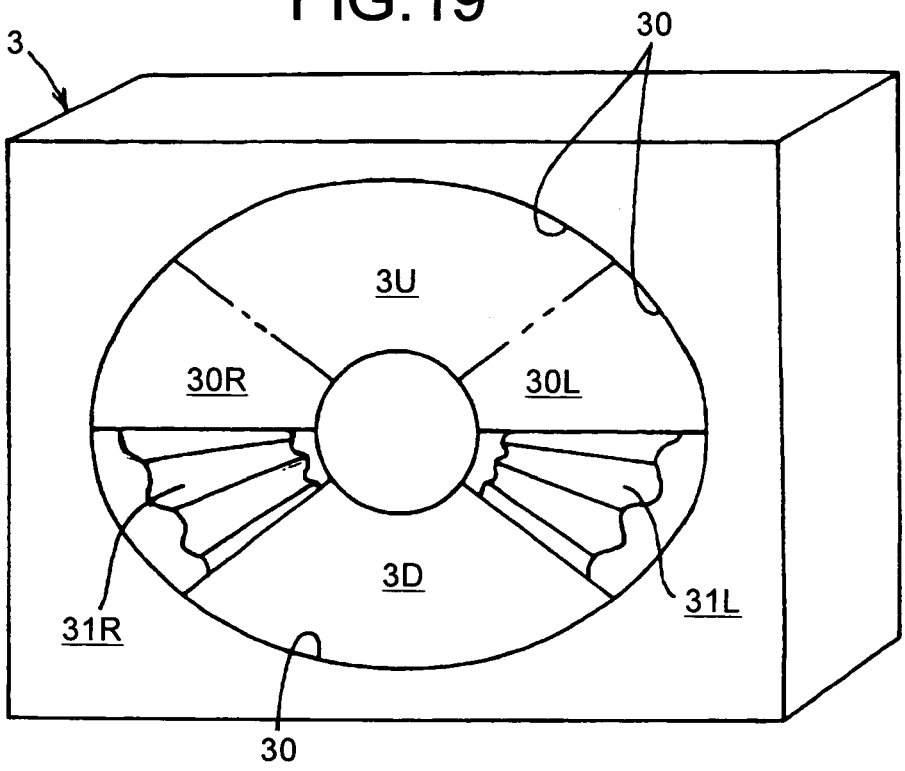
FIG. 19 is a perspective view of the reflector for illustrating an outline of the luminous intensity-improving reflection surface in the radial waveform in the left and the right segments on the reflection surface.
Figure 20:
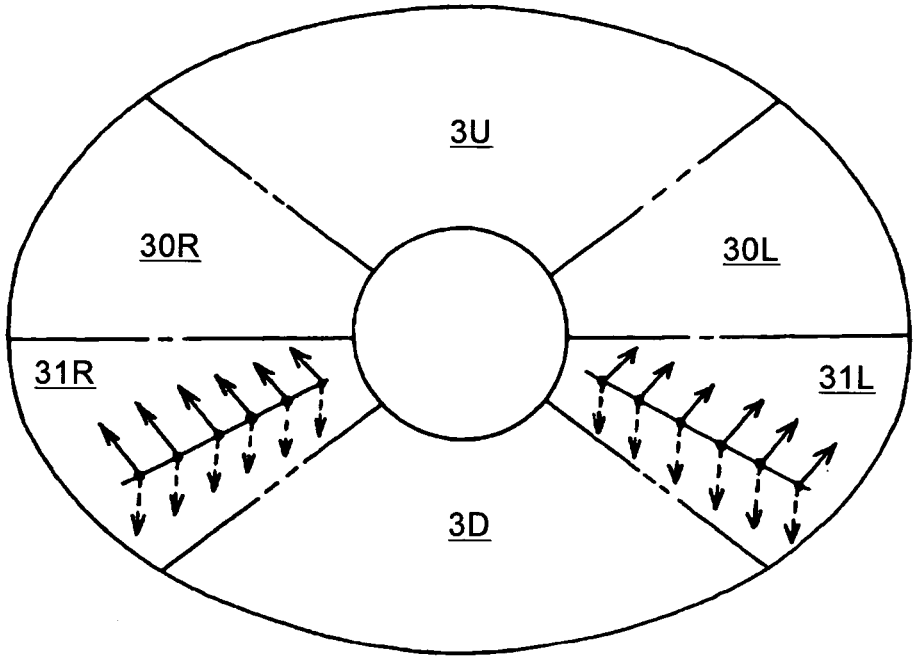
FIG. 20 is a schematic diagram for illustrating a method of forming the luminous intensity-improving reflection surface in the radial waveform in the left and the right segments on the reflection surface.

In the vehicle headlamp and the reflector according to the third embodiment, therefore, as shown in FIG. 19, the luminous intensity-improving reflection surfaces 31L and 31R in a radial waveform are formed in the shaded portions, in order to use the light from the discharge lamp 2 effectively. The luminous intensity-improving reflection surfaces 31L and 31R in the radial waveform are formed, as shown in FIG. 20, by shifting a certain point on the reflection surface in the shaded portion in the direction shown by the broken arrow (−n1, −n2, n3) in FIG. 20, with respect to the normal line (n1, n2, n3) shown by the solid line in FIG. 20. (n1, n2, n3) of the normal lines and (−n1, −n2, n3) of the direction indicate three axes (x, y, z) in the three-dimensional coordinates, for example, in FIG. 24. The x axis in the three-dimensional coordinates is in the depth direction (in the direction of optical axis of the reflector), the y axis is in the vertical direction with respect to the x axis (in the height direction of the reflector), and the z axis is in the horizontal direction with respect to the x axis (in the lateral (width) direction of the reflector).

The vehicle headlamp and the reflector according to the third embodiment have the configuration described above, and the operational effect thereof will be explained below.

Figure 16:
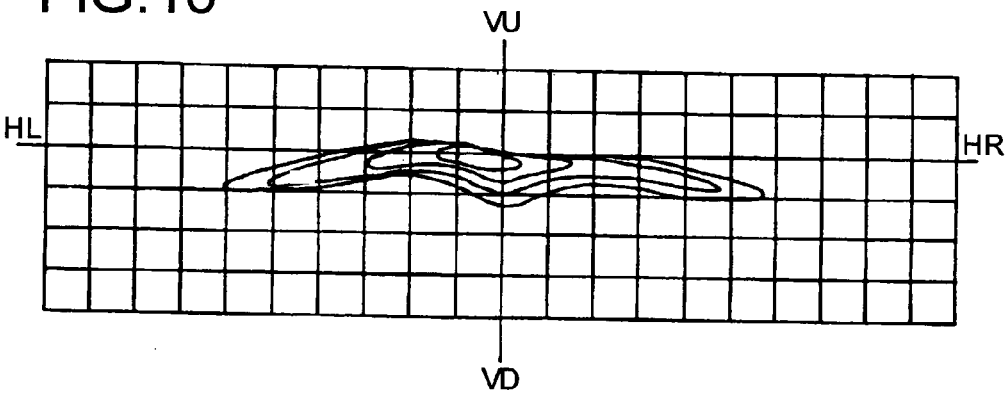
FIG. 16 is a light distribution pattern obtained by a luminous intensity improving reflection surface in a radial waveform, being shaded potions of the left and the right segments on the reflection surface at a time of the low beam.

That is, in the vehicle headlamp and the reflector according to the third embodiment, at the time of low beam, a light distribution pattern in which the left point is overstretched to about 30 degrees, the right point to about 29 degrees, and the vertical width to about 3 to 4 degrees can be obtained, as shown in FIG. 16, by the luminous intensity-improving reflection surfaces 31L and 31R in the radial waveform formed in the shaded portions. On the other hand, at the time of low beam, when the luminous intensity-improving reflection surfaces 31L and 31R in the radial waveform are not formed in the shaded portions, the light distribution pattern as shown in FIG. 15 is obtained, in which the left point is overstretched to about 28 degrees, but the right point is as narrow as about 13 degrees, and the vertical width at the left point is as narrow as about 1 degree. As is obvious from FIGS. 15 and 16, the luminous intensity-improving reflection surfaces 31L and 31R in the radial waveform formed in the shaded portion effectively use the light from the discharge lamp 2 at the time of low beam.

Figure 18:
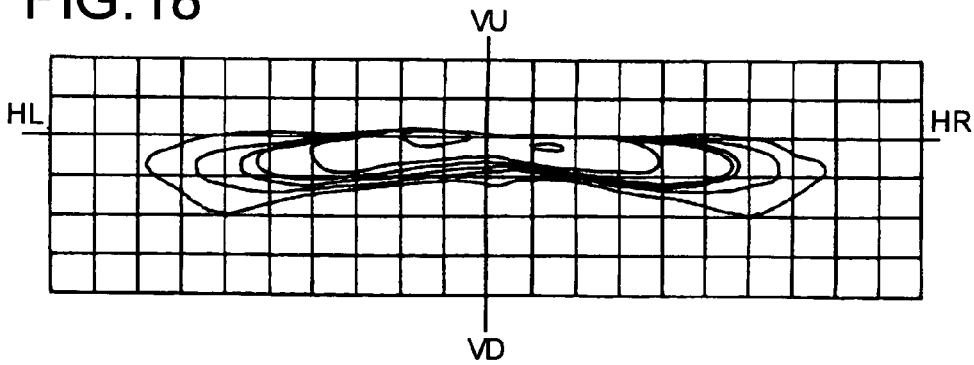
FIG. 18 is a light distribution pattern obtained by the left and the right segments (including the luminous intensity-improving reflection surface in the radial waveform) of the reflection surface at the time of the low beam.

Therefore, in the vehicle headlamp and the reflector according to the third embodiment, as shown in FIG. 18, a light distribution pattern in which the left and the right end portions in the 5000-candela zone are located closely to both the left and the right sides at about 20 degrees is obtained by the diffuse reflection surfaces 30L and 30R and the luminous intensity-improving reflection surfaces 31L and 31R, at the time of low beam. On the other hand, at the time of low beam, when only the diffuse reflection surfaces 30L and 30R are provided, as shown in FIG. 17, the light distribution pattern, in which the left and the right end portions in the 5000-candela zone are located closely to both the left and the right sides at about 15 degrees, is obtained. As is obvious from FIGS. 17 and 18, in the vehicle headlamp and the reflector according to the third embodiment, sufficient illuminance (luminous intensity) can be obtained in the diffused pattern section by the diffuse reflection surfaces 30L and 30R and the luminous intensity-improving reflection surfaces 31L and 31R.

In the vehicle headlamp and the reflector according to the third embodiment, the shape of the left and the right end portions of the light distribution pattern can be formed substantially in a rectangular shape by the wide area-illuminating reflection surfaces, the points of the left and the right end portions of the substantially rectangular shape of the light distribution pattern can be diffused to the left and the right by the diffuse reflection surfaces 30L and 30R. Further, the luminous intensity of the left and the right end portions of the light distribution pattern can be improved, which is formed substantially in a rectangular shape by the luminous intensity-improving reflection surfaces 31L and 31R, with the points diffused to the left and the right.

Figure 21:
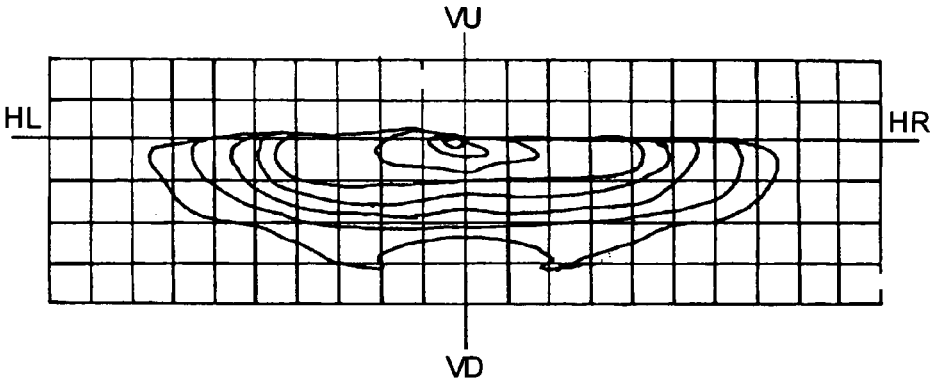
FIG. 21 is a light distribution pattern obtained by whole segments on the reflection surface (including the luminous intensity-improving reflection surface in the radial waveform)

As a result, the left and the right end portions in the 5000-candela zone of the light distribution pattern at the time of low beam, irradiated from the vehicle headlamp and the reflector according to the third embodiment are, as shown in FIG. 21, located closely to both the left and the right sides at about 22 degrees. As a result, the vehicle headlamp and the reflector according to the third embodiment can illuminate this side and the far side in the traveling direction at the time of cornering, and the luminous intensity at the left and the right end portions of the light distribution pattern can be improved, thereby reliably improving the visibility in the traveling direction at the time of cornering.

In the first to the third embodiments, the discharge lamp 2 is used for the light source, but in the present invention, a halogen lamp or the like may be used other than the discharge lamp 2.

In the first to the third embodiments, a projector type two-light vehicle headlamp has been explained. However, the present invention is also applicable to a projector type four-light vehicle headlamp and a projector type fog lamp.

In the first to the third embodiments, the light distribution pattern for passing by has been explained, but the present invention is also applicable to a light distribution pattern for driving and a light distribution pattern for a fog lamp.

One example of the embodiment of the reflector design program according to the present invention will be explained in detail, with reference to FIGS. 22 to 32. The reflector design program according to the embodiment is used in the reflector for the vehicle headlamp according to the first to the third embodiments.

Figure 22:
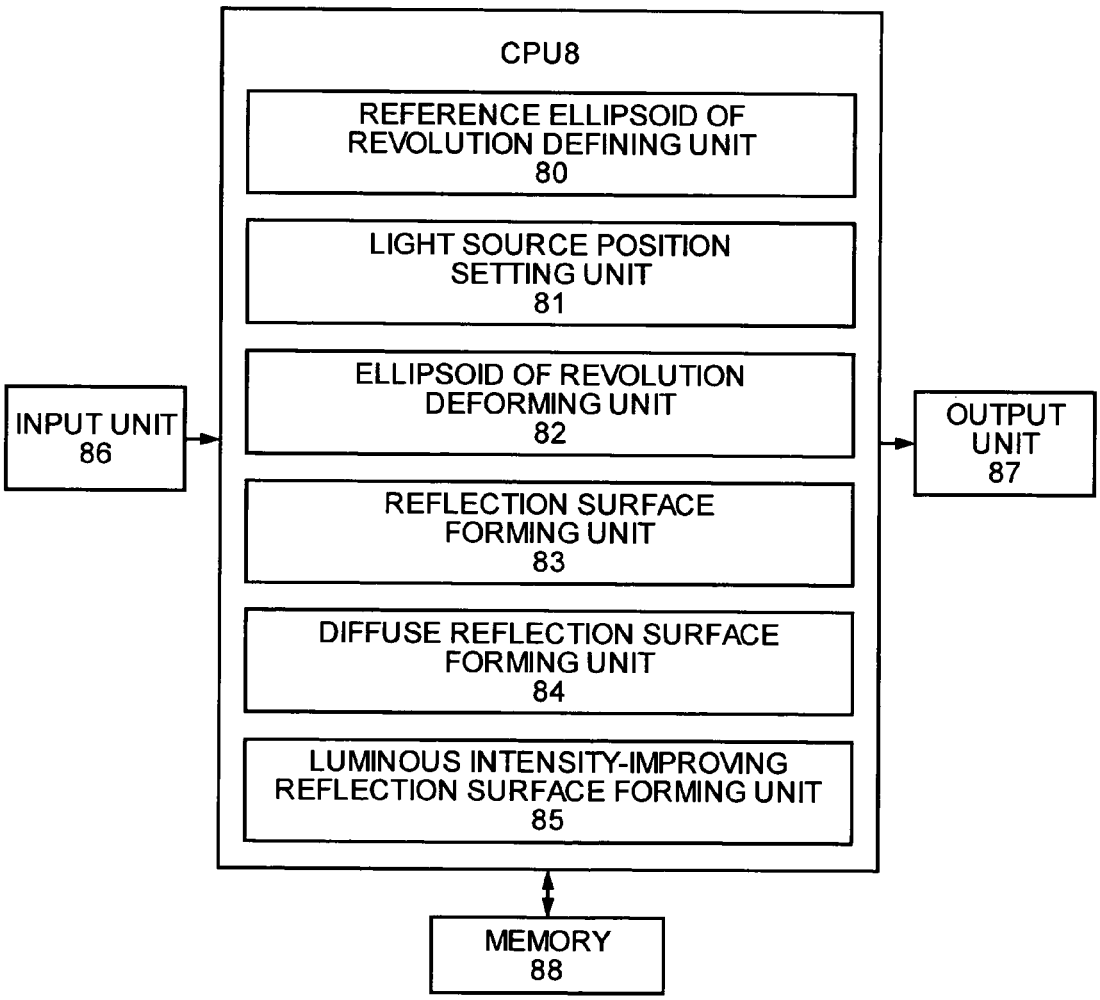
FIG. 22 is a functional block diagram of a reflector design program for the vehicle headlamp according to the present invention.

FIG. 22 is a functional block diagram illustrating one example of the design apparatus for the reflector, which performs functions by the reflector design program according to the embodiment. The design apparatus of the reflector will be explained below.

In FIG. 22, the reference numeral 8 refers to a central processing unit (CPU). This CPU 8 includes a reference ellipsoid of revolution defining unit 80, a light source position setting unit 81, an ellipsoid of revolution deforming unit 82, a reflection surface forming unit (wide area-illuminating reflection surface forming unit) 83, a diffuse reflection surface forming unit 84, and a luminous intensity-improving reflection surface forming unit 85. To the CPU 8 are connected an input unit 86, an output unit 87, and a memory 88, respectively.

The input unit 86 is formed of, for example, a keyboard and a mouse. The input unit 86 includes a first input unit that inputs size data of a reference reflector (hereinafter, "reflector data") to the reference ellipsoid of revolution defining unit 80, a second input unit that inputs position data of the light source to the light source position setting unit 81, a third input unit that inputs shift data for shifting the control points (hereinafter, "first shift data") to the ellipsoid of revolution deforming unit 82, a fourth input unit that inputs a weight in a quadratic equation for a rational B-spline surface (hereinafter, "weight") to the reflection surface forming unit 83, a fifth input unit that inputs shift data for shifting number-increased control points (hereinafter, "second shift data") to the diffuse reflection surface forming unit 84, and a sixth input unit that inputs an execution command to the luminous intensity-improving reflection surface forming unit 85. The input unit 86 inputs the data and execution commands to the CPU 8 by the operator's operation.

The output unit 87 is formed of, for example, a display, and displays the processing process and the processing result by the CPU 8 by an image, characters and figures. The memory 88 is formed of, for example, database, read only memory (ROM), random access memory (RAM), a hard disk (HD) or a flexible disk (FD), and stores various data rewritably.

The CPU 8 operates the reference ellipsoid of revolution defining unit 80, the light source position setting unit 81, the ellipsoid of revolution deforming unit 82, the reflection surface forming unit 83, the diffuse reflection surface forming unit 84, and the luminous intensity-improving reflection surface forming unit 85, based on the data or the execution command input from the input unit 86, according to the reflector design program according to the embodiment. The CPU 8 outputs the processing process and the processing result of the units 80 to 85 to the output unit 87. Further, the CPU 8 reads necessary data from the memory 88 or writes necessary data in the memory 88 according to the reflector design program, and the execution command input from the input unit 86.

Figure 23:
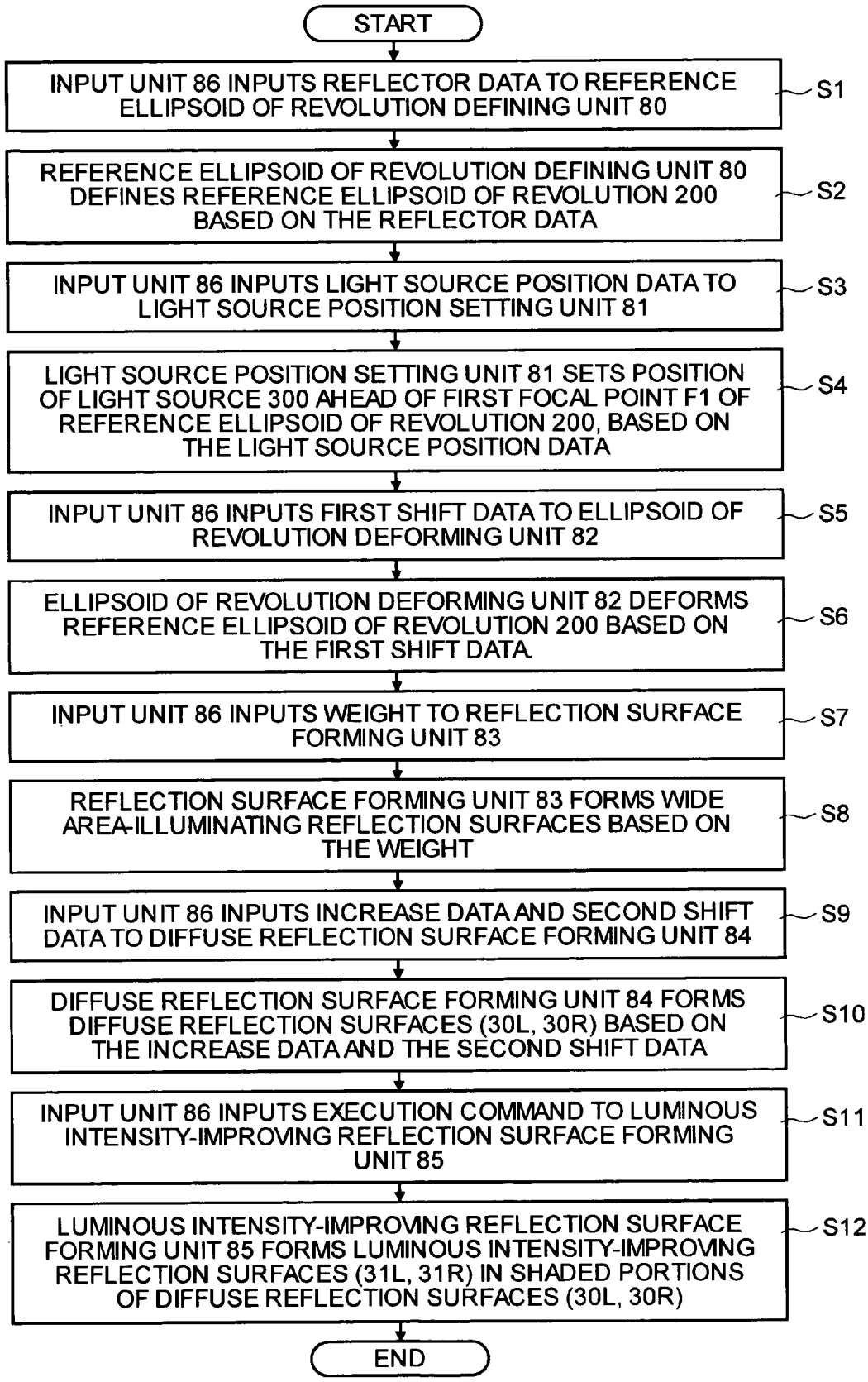
FIG. 23 is a flowchart of a reflector design program for the vehicle headlamp according to the present invention.

FIG. 23 is a flowchart illustrating one example of the reflector design method, executed by the reflector design program according to the embodiment. The reflector design method will be explained below.

At first, the reflector design program according to the embodiment is executed by the operators operation. In other words, the input unit 86 (the first input unit) inputs the reflector data to the CPU 8 by the operators operation (first step S1). The size of the reference reflector is set, taking into consideration the design of the headlamp itself, and the design of the vehicle equipped with the headlamp, according to the design specification in the database.

Figure 24:
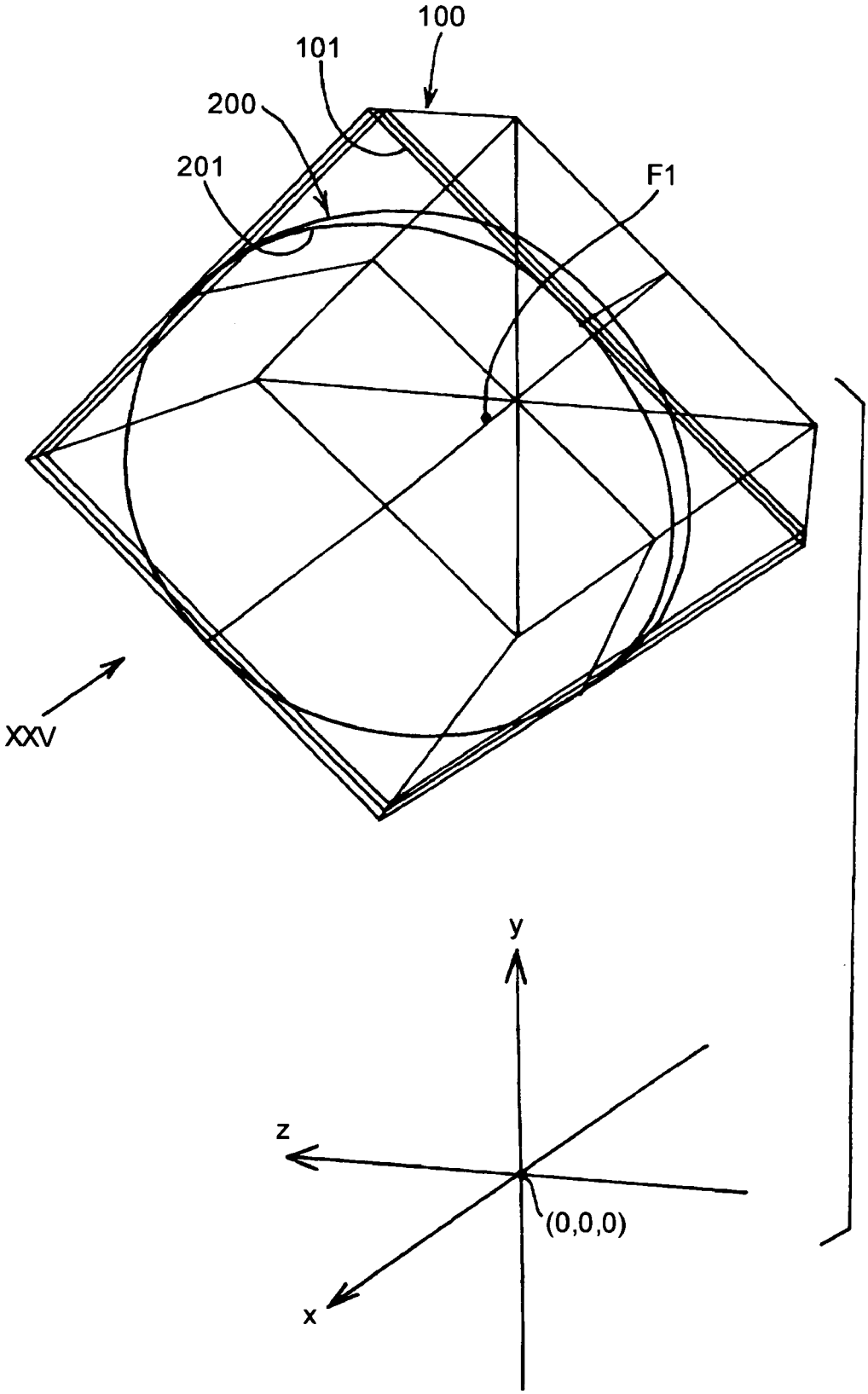
FIG. 24 is a schematic diagram for illustrating the definition of a reference ellipsoid of revolution.

The CPU 8 makes the reference ellipsoid of revolution defining unit 80 execute the operation. In other words, the reference ellipsoid of revolution defining unit 80 determines a reference box 100 based on the reflector data. The reference box 100 is, as shown in FIG. 24, in a hollow hexahedral shape, being square as seen from the front. The front of the reference box 100 is open. The front opening of the reference box 100 is referred to as a front opening 101.

The reference ellipsoid of revolution defining unit 80 defines the reference ellipsoid of revolution 200 housed in the reference box 100 without play, based on the reflector data, from the following quadratic equation (1) for the rational B-spline surface. The reference ellipsoid of revolution 200 is defined from two parameters [u] and [w] (u represents the depth direction and w represents the height and width directions), as shown in the following equation (1). As shown in FIG. 24, the reference ellipsoid of revolution 200 is cut in the front opening 101 of the reference box 100. The cut opening of the reference ellipsoid of revolution 200 is referred to as an opening 201. As shown in FIG. 24, the opening 201 of the reference ellipsoid of revolution 200 and the middle points at four edges of the front opening 101 of the reference box 100 are brought into contact with each other, and the apex of the reference ellipsoid of revolution 200 and the center on the bottom of the reference box 100 are brought into contact with each other.

$$Q(u, w) = \frac{\sum_{i=1}^{n+1}\sum_{j=1}^{m+1} h_{i,j}B_{i,j}N_{i,k}(u)M_{j,l}(w)}{\sum_{i=1}^{n+1}\sum_{j=1}^{m+1} h_{i,j}N_{i,k}(u)M_{j,l}(w)} \quad (1)$$

where N, M: B-spline function

B: control point h: weight

The equation (1) is an equation for NURBS described in "Mathematical Elements for Computer Graphics" (David F. Rogers, J. Alan Adams).

In the reference box 100 and the reference ellipsoid of revolution 200, as shown in FIG. 24, it is assumed that the depth direction (direction of optical axis of the reflector) is x axis, the vertical direction with respect to x axis (the height direction of the reflector) is y axis, the horizontal direction with respect to the x axis (the lateral (width) direction of the reflector) is z axis, and the first focal point F1 of the reference ellipsoid of revolution 200 is an intersection of coordinate axes (0, 0, 0), respectively in the three-dimensional coordinates. Since the reference ellipsoid of revolution 200 is cut in the front opening 101 of the reference box 100, one focal point, that is, the first focal point F1 of the two focal points is shown.

Figure 25:
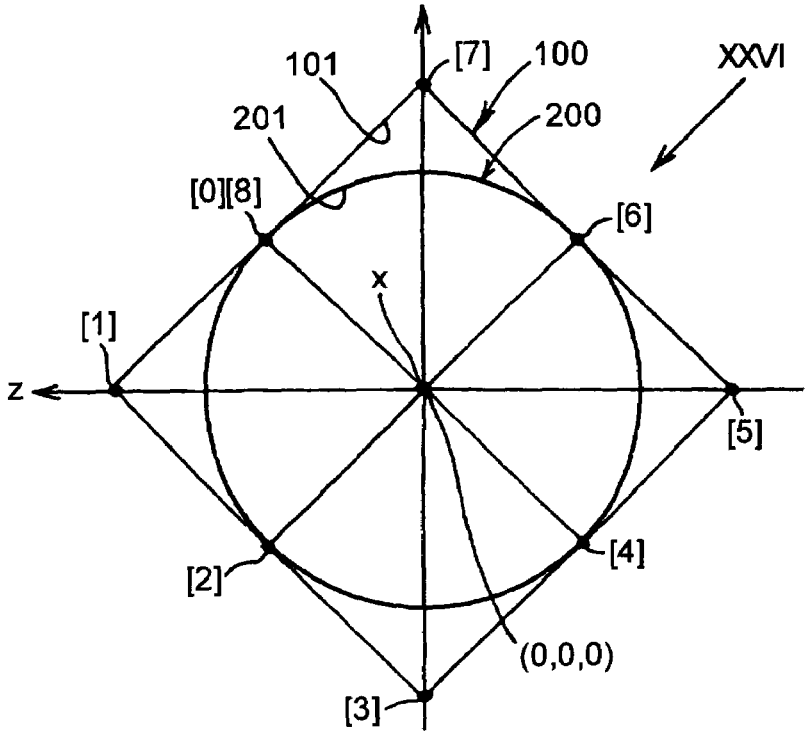
FIG. 25 is a schematic diagram for illustrating control points in a height direction and a lateral direction.

The reference ellipsoid of revolution defining unit 80 further determines control points B in the reference box 100. That is, in the height direction and the lateral direction [j], as shown in FIG. 25, in total nine points of [0], [1], [2], [3], [4], [5], [6], [7], and [8] are determined. The control points B in the height direction and the lateral direction [j] are formed of four corners of the reference box 100, and four contact points between the front opening 101 of the reference box 100 and the opening 201 of the reference ellipsoid of revolution 200. The start point [0] and the end point [8] are the same.

Figure 26:
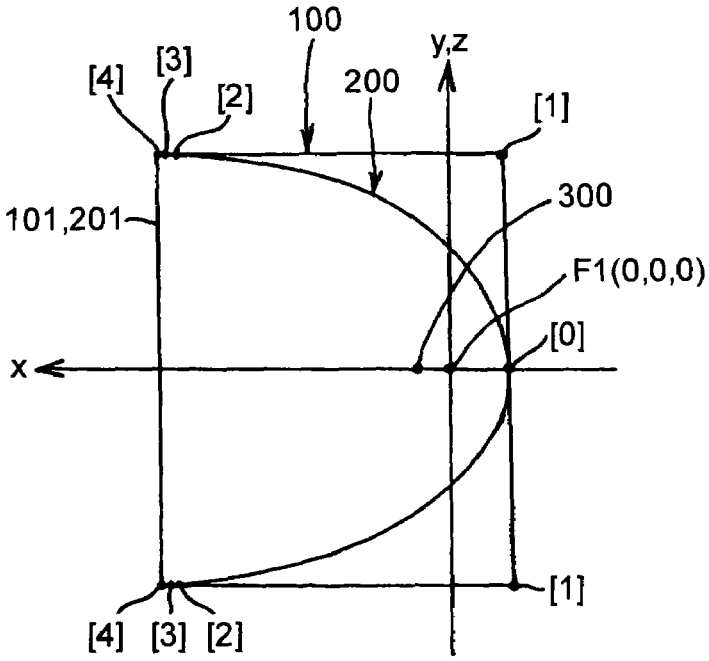
FIG. 26 is a schematic diagram for illustrating control points in a depth direction.

Further, in the depth direction [i], as shown in FIG. 26, in total five points of [0], [1], [2], [3], and [4] are determined. The control points B in the depth direction [i] are formed of a point where the center on the bottom of the reference box 100 and the apex of the reference ellipsoid of revolution 200 are brought into contact with each other on the x axis, corners between the bottom and the sides of the reference box 100, corners between the front (front opening 101) and the sides of the reference box 100, and optional two points on the sides of the reference box 100.

Figure 27:
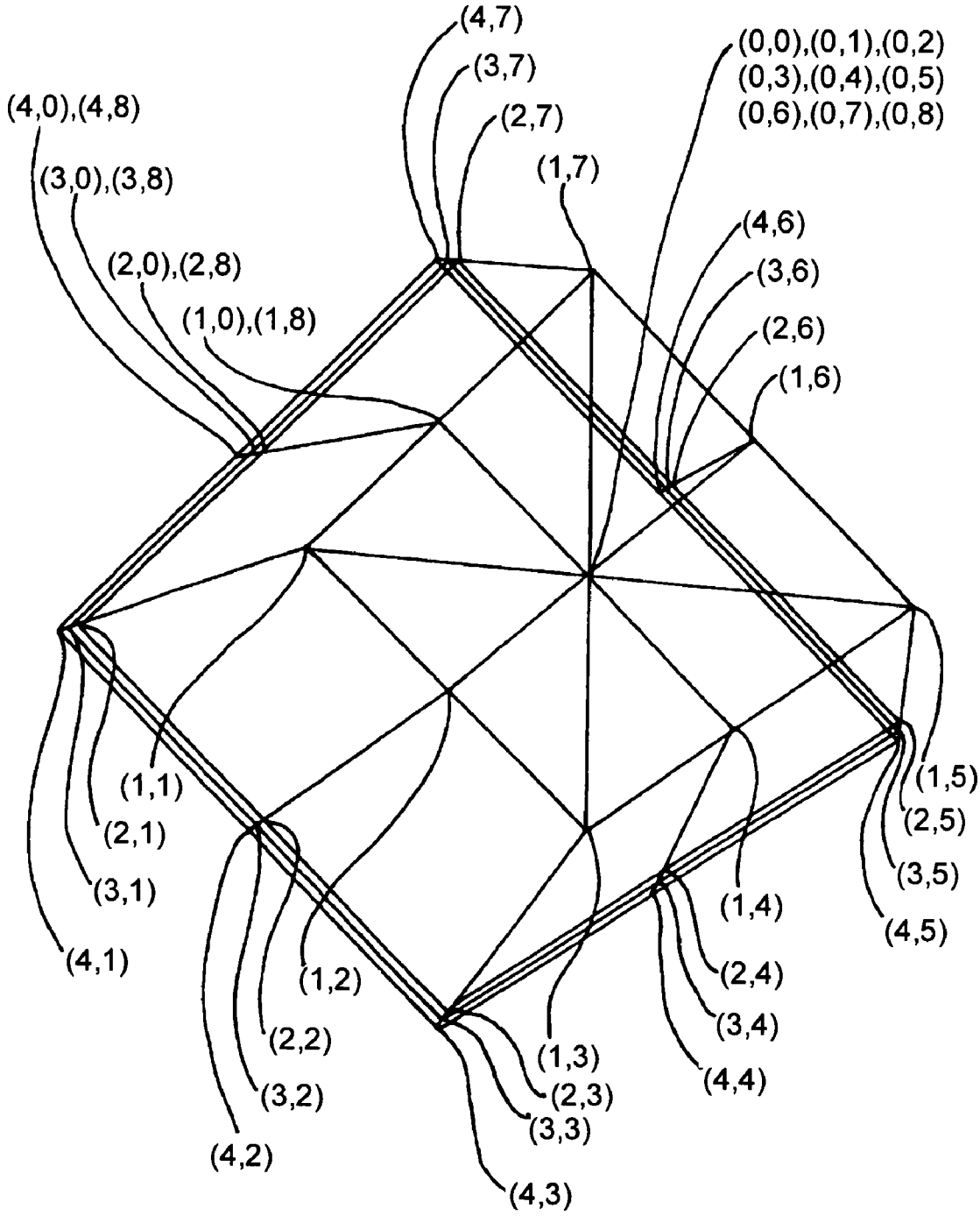
FIG. 27 is a schematic diagram for illustrating overall control points.

As a result, the total number (j×i) of the control points B is, as shown in FIG. 27, 45 points (9×5=45). The three-dimensional coordinates of the 45 control points B (i, j) is as shown in the following table 1.

TABLE 1

| B[i][j] = | x | y | z | (mm) |
|---|---|---|---|---|
| B[0][0] = | [−13.576873, | 0.000000, | 0.000000] | |
| B[0][1] = | [−13.576873, | 0.000000, | 0.000000] | |
| B[0][2] = | [−13.576873, | 0.000000, | 0.000000] | |
| B[0][3] = | [−13.576873, | 0.000000, | 0.000000] | |
| B[0][4] = | [−13.576873, | 0.000000, | 0.000000] | |
| B[0][5] = | [−13.576873, | 0.000000, | 0.000000] | |
| B[0][6] = | [−13.576873, | 0.000000, | 0.000000] | |
| B[0][7] = | [−13.576873, | 0.000000, | 0.000000] | |
| B[0][8] = | [−13.576873, | 0.000000, | 0.000000] | |
| B[1][0] = | [−13.576873, | 26.516504, | 26.516504] | |
| B[1][1] = | [−13.576873, | 0.000000, | 53.033009] | |
| B[1][2] = | [−13.576873, | −26.516504, | 26.516504] | |
| B[1][3] = | [−13.576873, | −53.033009, | 0.000000] | |
| B[1][4] = | [−13.576873, | −26.516504, | −26.516504] | |
| B[1][5] = | [−13.576873, | 0.000000, | −53.033009] | |
| B[1][6] = | [−13.576873, | 26.516504, | −26.516504] | |
| B[1][7] = | [−13.576873, | 53.033009, | 0.000000] | |
| B[1][8] = | [−13.576873, | 26.516504, | 26.516504] | |
| B[2][0] = | [45.000000, | 26.516504, | 26.516504] | |
| B[2][1] = | [45.000000, | 0.000000, | 53.033009] | |
| B[2][2] = | [45.000000, | −26.516504, | 26.516504] | |
| B[2][3] = | [45.000000, | −53.033009, | 0.000000] | |
| B[2][4] = | [45.000000, | −26.516504, | −26.516504] | |
| B[2][5] = | [45.000000, | 0.000000, | −53.033009] | |
| B[2][6] = | [45.000000, | 26.516504, | −26.516504] | |
| B[2][7] = | [45.000000, | 53.033009, | 0.000000] | |
| B[2][8] = | [45.000000, | 26.516504, | 26.516504] | |
| B[3][0] = | [46.500000, | 26.516504, | 26.516504] | |
| B[3][1] = | [46.500000, | 0.000000, | 53.033009] | |
| B[3][2] = | [46.500000, | −26.516504, | 26.516504] | |
| B[3][3] = | [46.500000, | −53.033009, | 0.000000] | |
| B[3][4] = | [46.500000, | −26.516504, | −26.516504] | |
| B[3][5] = | [46.500000, | 0.000000, | −53.033009] | |
| B[3][6] = | [46.500000, | 26.516504, | −26.516504] | |
| B[3][7] = | [46.500000, | 53.033009, | 0.000000] | |
| B[3][8] = | [46.500000, | 26.516504, | 26.516504] | |
| B[4][0] = | [48.000000, | 26.516504, | 26.516504] | |
| B[4][1] = | [48.000000, | 0.000000, | 53.033009] | |
| B[4][2] = | [48.000000, | −26.516504, | 26.516504] | |
| B[4][3] = | [48.000000, | −53.033009, | 0.000000] | |
| B[4][4] = | [48.000000, | −26.516504, | −26.516504] | |
| B[4][5] = | [48.000000, | 0.000000, | −53.033009] | |
| B[4][6] = | [48.000000, | 26.516504, | −26.516504] | |
| B[4][7] = | [48.000000, | 53.033009, | 0.000000] | |
| B[4][8] = | [48.000000, | 26.516504, | 26.516504] | |

The reference ellipsoid of revolution defining unit 80 determines the reference box 100 having the front opening 101 with the front being open, based on the reflector data, defines the reference ellipsoid of revolution 200 housed in the reference box 100 without play, from the quadratic equation for the rational B-spline surface shown in the above equation (1), and determines the control points B [i] [j] of the reference box 100 (second step S2).

The input unit 86 (second input unit) inputs the position data of the light source to the CPU 8 (third step S3), by the operators operation.

Figure 28:
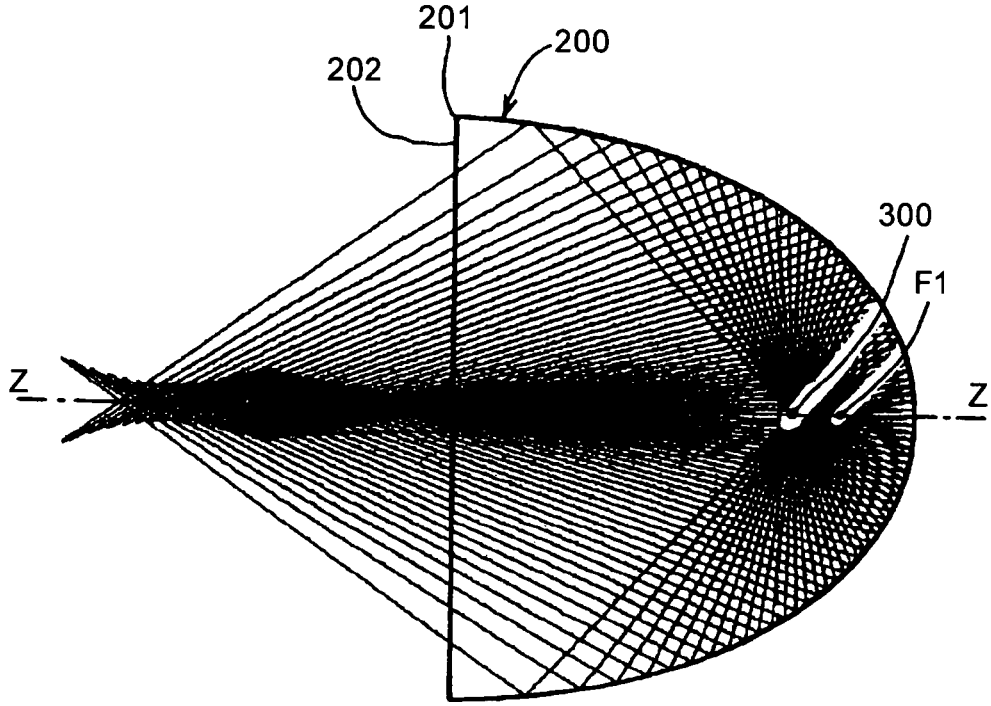
FIG. 28 is a schematic diagram for illustrating an installed state of the light source.

The CPU 8 makes the light source position setting unit 81 execute the operation. That is, the light source position setting unit 81 sets the position of a light source 300, based on the position data of the light source. The position of the light source is located on the optical axis Z—Z of the reference ellipsoid of revolution 200, and slightly ahead of the first focal point F1 (on the condenser lens 4 side, and on the opening 201 side of the reference ellipsoid of revolution 200), designating the reference ellipsoid of revolution 200 as a reflection surface. The light source position setting unit 81 arranges the light source 300 at this position. Then, the light from the light source 300 is, as shown in FIG. 28, reflected by the reflection surface of the reference ellipsoid of revolution 200, and condensed on the face of the opening 201 of the reference ellipsoid of revolution 200, that is, on the reference plane 202. In FIG. 28, in order to clarify the positions of the light source 300 and the first focal point F1, and the leader thereof, illustration of the optical path near the light source 300 and the first focal point F1, and near the leader is omitted. When the position of the light source 300 is set, a substantially circular reference light distribution pattern as shown in FIG. 29 is obtained.

In this manner, the light source position setting unit 81 sets the position of the light source 300 ahead of the first focal point F1 of the reference ellipsoid of revolution 200, based on the position data of the light source (fourth step S4).

Figure 29:
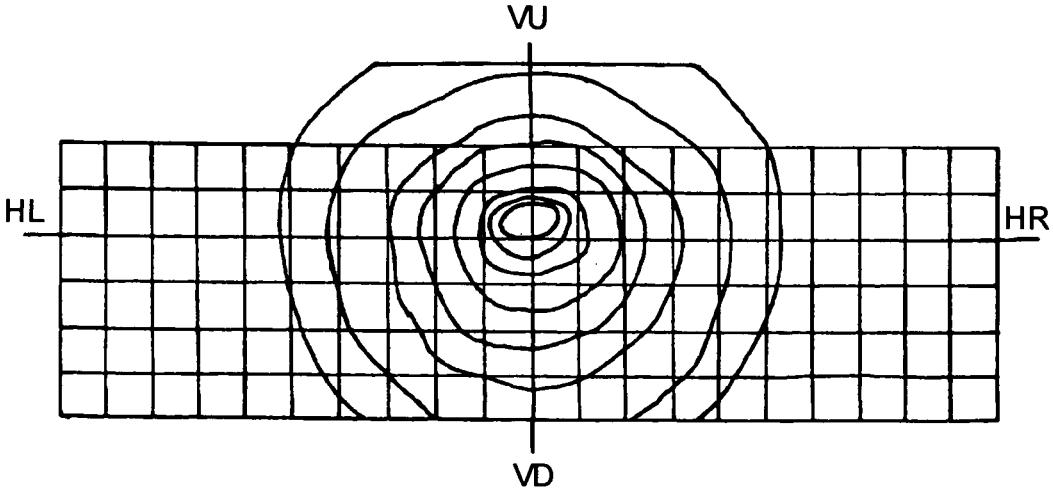
FIG. 29 is a light distribution pattern obtained from configuration illustrated in FIG. 28.

However, since the light distribution pattern shown in FIG. 29 is substantially in a circular shape, it is not suitable for an oblong light distribution pattern of the vehicle headlamp.

Therefore, in the reflector design program according to the embodiment, the following step is executed by the operator's operation. That is, the input unit 86 (third input unit) inputs the first shift data to the CPU 8 by the operator's operation (fifth step S5).

Figure 30:
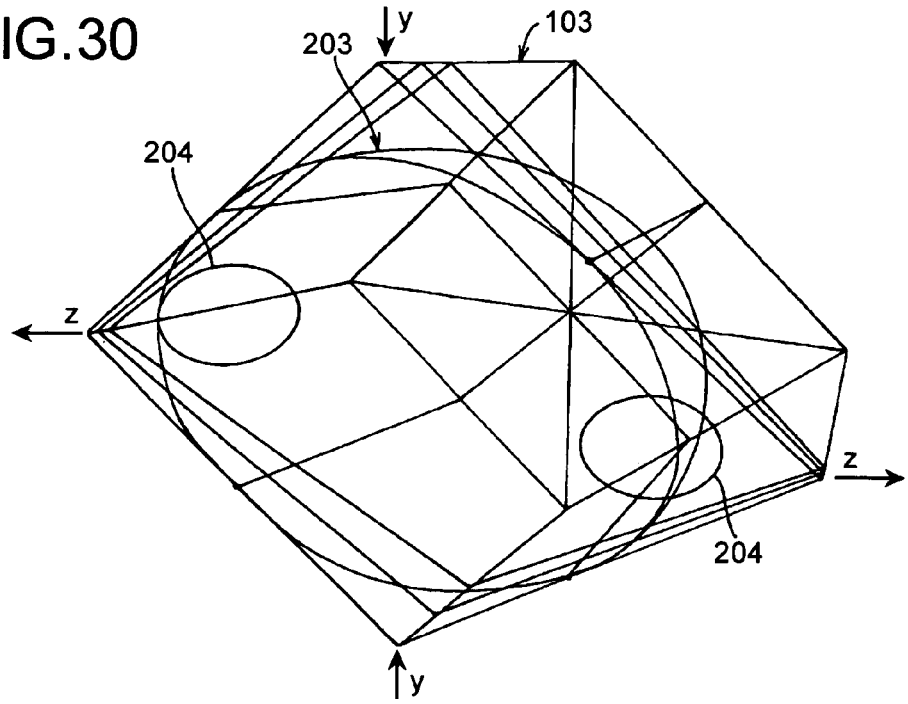
FIG. 30 is a deformed ellipsoid of revolution formed by deforming the reference ellipsoid of revolution.

The CPU 8 makes the ellipsoid of revolution deforming unit 82 execute the operation. That is, the ellipsoid of revolution deforming unit 82 shifts the 45 control points B of the reference box 100, based on the first shift data. As a result, as shown in FIG. 30, the ellipsoid of revolution deforming unit 82 deforms the reference ellipsoid of revolution 200 by enlarging it in the direction of arrow z (in the z-axis direction, horizontal direction, left and right direction), and crushing it in the direction of arrow y (in the y-axis direction, vertical direction, up and down direction), to form a deformed ellipsoid of revolution 203. At this time, as shown in FIG. 30, the reference box 100 is also deformed by enlarging it in the direction of arrow z (in the z-axis direction, horizontal direction, left and right direction), and crushing it in the direction of arrow y (in the y-axis direction, vertical direction, up and down direction). The three-dimensional coordinates of the 45 control points B of the deformed box 103 formed in this manner are as shown in Table 2 below.

TABLE 2

| B[i][j] = | x | y | z | (mm) |
|---|---|---|---|---|
| B[0][0] = | [−13.576873, | 0.000000, | 0.000000] | |
| B[0][1] = | [−13.576873, | 0.000000, | 0.000000] | |
| B[0][2] = | [−13.576873, | 0.000000, | 0.000000] | |
| B[0][3] = | [−13.576873, | 0.000000, | 0.000000] | |
| B[0][4] = | [−13.576873, | 0.000000, | 0.000000] | |
| B[0][5] = | [−13.576873, | 0.000000, | 0.000000] | |
| B[0][6] = | [−13.576873, | 0.000000, | 0.000000] | |
| B[0][7] = | [−13.576873, | 0.000000, | 0.000000] | |
| B[0][8] = | [−13.576873, | 0.000000, | 0.000000] | |
| B[1][0] = | [−13.576873, | 27.179417, | 27.842330] | |
| B[1][1] = | [−13.576873, | 0.000000, | 55.684659] | |
| B[1][2] = | [−13.576873, | −24.792932, | 27.842330] | |
| B[1][3] = | [−13.576873, | −49.585863, | 0.000000] | |
| B[1][4] = | [−13.576873, | −24.792932, | −27.842330] | |
| B[1][5] = | [−13.576873, | 0.000000, | −55.684659] | |

TABLE 2-continued

| B[i][j] = | x | y | z | (mm) |
|---|---|---|---|---|
| B[1][6] = | [−13.576873, | 27.179417, | −27.842330] | |
| B[1][7] = | [−13.576873, | 54.358834, | 0.000000] | |
| B[1][8] = | [−13.576873, | 27.179417, | 27.842330] | |
| B[2][0] = | [37.000000, | 27.179417, | 33.145630] | |
| B[2][1] = | [45.000000, | 0.000000, | 66.291261] | |
| B[2][2] = | [35.000000, | −24.792932, | 33.145630] | |
| B[2][3] = | [25.000000, | −49.585863, | 0.000000] | |
| B[2][4] = | [35.000000, | −24.792932, | −33.145630] | |
| B[2][5] = | [45.000000, | 0.000000, | −66.291261] | |
| B[2][6] = | [37.000000, | 27.179417, | −33.145630] | |
| B[2][7] = | [29.000000, | 54.358834, | 0.000000] | |
| B[2][8] = | [37.000000, | 27.179417, | 33.145630] | |
| B[3][0] = | [42.500000, | 27.179417, | 33.722340] | |
| B[3][1] = | [46.500000, | 0.000000, | 66.562868] | |
| B[3][2] = | [41.500000, | −24.792932, | 33.855257] | |
| B[3][3] = | [36.500000, | −49.585863, | 0.000000] | |
| B[3][4] = | [41.500000, | −24.792932, | −33.855257] | |
| B[3][5] = | [46.500000, | 0.000000, | −66.562868] | |
| B[3][6] = | [42.500000, | 27.179417, | −33.722340] | |
| B[3][7] = | [38.500000, | 54.358834, | 0.000000] | |
| B[3][8] = | [42.500000, | 27.179417, | 33.722340] | |
| B[4][0] = | [48.000000, | 27.179417, | 34.299049] | |
| B[4][1] = | [48.000000, | 0.000000, | 66.834475] | |
| B[4][2] = | [48.000000, | −24.792932, | 34.564884] | |
| B[4][3] = | [48.000000, | −49.585863, | 0.000000] | |
| B[4][4] = | [48.000000, | −24.792932, | −34.564884] | |
| B[4][5] = | [48.000000, | 0.000000, | −66.834475] | |
| B[4][6] = | [48.000000, | 27.179417, | −34.299049] | |
| B[4][7] = | [48.000000, | 54.358834, | 0.000000] | |
| B[4][8] = | [48.000000, | 27.179417, | 34.299049] | |

Figure 31:
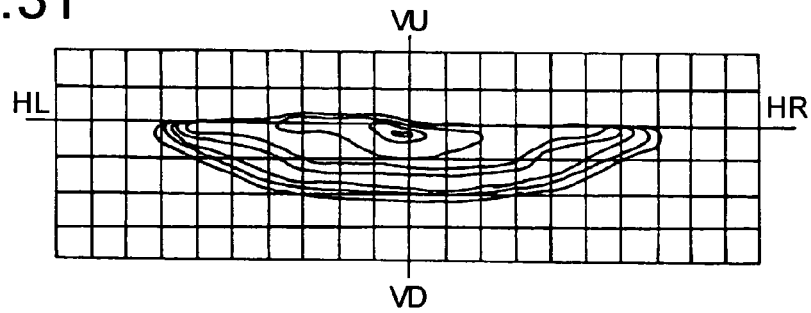
FIG. 31 is a light distribution pattern obtained from configuration illustrated in FIG. 30.
Figure 32:
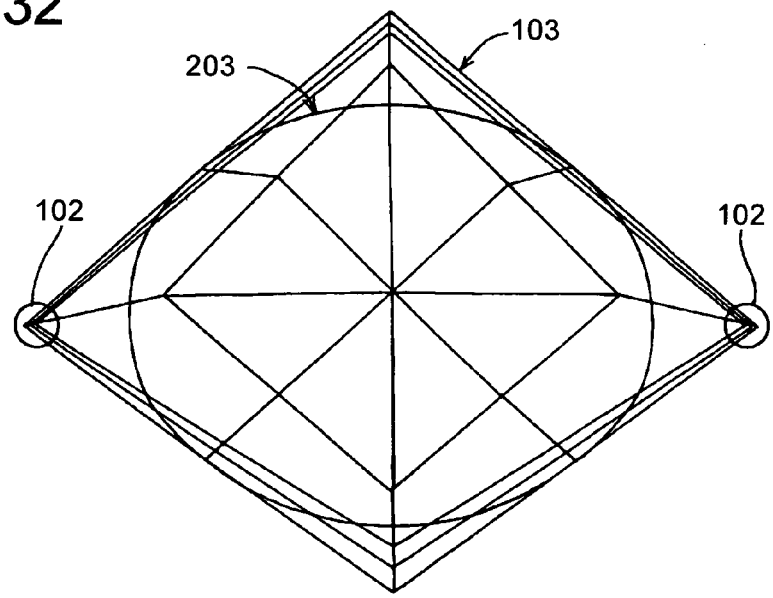
FIG. 32 is a schematic diagram for illustrating a state in which a weight of the deformed ellipsoid of revolution is changed.

The deformed ellipsoid of revolution 203 is used as the reflection surface, and the light source 300 at a predetermined position is turned on, thereby to obtain an oblong light distribution pattern as shown in FIG. 31. The oblong light distribution pattern shown in FIG. 31 is suitable for the light distribution pattern of the vehicle headlamp. The left and the right end portions of the light distribution pattern shown in FIG. 31 illuminate the road surface in the traveling direction at the time of cornering.

The ellipsoid of revolution deforming unit 82 shifts the control points B of the reference box 100 based on the first shift data, and deforms the reference ellipsoid of revolution 200 by enlarging it horizontally and crushing it vertically, to thereby form the deformed ellipsoid of revolution (sixth step S6).

However, the lower edges of the left and the right end portions of the light distribution pattern shown in FIG. 31 substantially form an oblong semi-elliptical shape, and the gradient of the lower edge (vertical/horizontal) is about ½. Therefore, in the light distribution pattern shown in FIG. 31, as shown in FIG. 31, the most part of the range of about 20 to 35 degrees on the left and about 5 to 10 degrees downward, and the most part of the range of about 20 to 35 degrees on the right and about 5 to 10 degrees downward cannot be illuminated. In other words, in the light distribution pattern shown in FIG. 31, this side in the traveling direction at the time of cornering cannot be illuminated.

Therefore, in the reflector design program according to the embodiment, the following step is executed by the operator's operation. That is, the input unit 86 (the fourth input unit) inputs a weight h to the CPU 8 by the operator's operation (seventh step S7).

The CPU 8 makes the reflection surface forming unit 83 execute the operation. That is, the reflection surface forming unit 83 sets the weight h of the control points B (points in portions enclosed by a small circle 102 in FIG. 32), which are involved in the control of the left and the right end portions of the light distribution pattern, of the 45 control points B of the deformed box 103, to a value smaller than h=0.707 when the ellipsoid of revolution is defined. The control points B in the portions enclosed by the small circle 102 are (2, 1), (3, 1), (4, 1), (2, 5), (3, 5), and (4, 5).

When the weight h becomes smaller than 0.707, as shown in FIG. 3, the lower edge of the left and the right end portions of the light distribution pattern form substantially an oblong rectangle. Therefore, the light distribution pattern shown in FIG. 3 can illuminate the most part of the range of about 20 to 33 degrees on the left and about 5 to 10 degrees downward, and the most part of the range of about 20 to 33 degrees on the right and about 5 to 10 degrees downward, that is, this side in the traveling direction at the time of cornering. As a result, the light distribution pattern shown in FIG. 3 can improve the visibility in the traveling direction at the time of cornering.

As described above, the reflection surface forming unit 83 sets the weight h of the control points B, which are involved in the control of the left and the right end portions of the light distribution pattern, of the control points B of the deformed box 103, to a value smaller than the value when the ellipsoid of revolution is defined. As a result, the reflection surface forming unit 83 forms the wide area-illuminating reflection surfaces that can obtain the light distribution pattern shown in FIG. 3 on the reflection surface of the deformed ellipsoid of revolution 203 (eighth step S8). The wide area-illuminating reflection surfaces correspond to the wide area-illuminating reflection surfaces in the left and the right segments 3L and 3R in vehicle headlamp and the reflector according to the first to the third embodiments.

In the light distribution pattern shown in FIG. 3, the points of the left and the right end portions are located closely to both the left and the right sides at about 33 degrees. In order to further improve the visibility in the traveling direction at the time of cornering, it is necessary to diffuse the points of the left and the right end portions of the light distribution pattern shown in FIG. 3 further to left and right.

The reflection surfaces forming the left and the right end portions of the light distribution pattern are portions enclosed by small ellipses 204 in FIG. 30, of the reflection surface of the deformed ellipsoid of revolution 203, that is, the reflection surfaces in the exit portions on the left and the right sides. The points of the left and the right end portions of the light distribution pattern is further diffused to left and right, by locally controlling the reflection surface in the portion enclosed by the small ellipse 204. In order to locally control the reflection surface in the portion enclosed by the small ellipse 204, it is necessary to increase the control points B to more than 45 points, for example, 19×83=1577 points.

Therefore, the reflector design program according to the embodiment executes the following step by the operator's operation. That is, the input unit 86 (the fifth input unit) inputs the increase data and the second shift data to the CPU 8 by the operator's operation (ninth step S9).

The CPU 8 makes the diffuse reflection surface forming unit 84 execute the operation. That is, the diffuse reflection surface forming unit 84 increases the number of the control points from 45 to 1577 based on the increase data. As a result, the diffuse reflection surface forming unit 84 can locally control the exit portions on the left and the right sides of the reflection surface of the deformed ellipsoid of revolution 203. The number of the control points to be increased can be optionally determined according to the accuracy of the local control of the reflection surface and the processing capacity of the computer.

The diffuse reflection surface forming unit 84 then shifts the control points, which have been increased to 1577, based on the second shift data. Hence, the exit portions on the left and the right sides of the reflection surface of the deformed ellipsoid of revolution 203 are locally controlled. As a result, the points of the left and the right end portions of the light distribution pattern shown in FIG. 3 is further diffused to left and right, and the light distribution pattern as shown in FIG. 12 can be obtained. Since the points of the left and the right end portions are diffused to left and right up to the vicinity of about 38 degrees, the light distribution pattern shown in FIG. 12 can further improve the visibility in the traveling direction at the time of cornering.

The diffuse reflection surface forming unit 84 thus forms the diffuse reflection surfaces 30L and 30R, which can obtain the light distribution pattern shown in FIG. 12, on the reflection surface of the deformed ellipsoid of revolution (tenth step S10). The diffuse reflection surfaces 30L and 30R correspond to the diffuse reflection surface 30L including the wide area-illuminating reflection surface in the left segment and the diffuse reflection surface 30R including the wide area-illuminating reflection surface in the right segment, in the vehicle headlamp and the reflector in the first to the third embodiments.

In the light distribution pattern shown in FIG. 12, since the left and the right end portions in the 5000-candela zone are located closely to both the left and the right sides at about 15 degrees, sufficient illuminance cannot be obtained in the diffused pattern portion.

Therefore, the reflector design program according to the embodiment executes the following step by the operators operation. That is, the input unit 86 (the sixth input unit) inputs an execution command for forming a luminous intensity-improving reflection surface to the CPU 8 (eleventh step S11).

Then, the CPU 8 makes the luminous intensity-improving reflection surface forming unit 85 execute the operation. That is, the luminous intensity-improving reflection surface forming unit 85 forms the luminous intensity-improving reflection surfaces 31L and 31R in the radial waveform in the shaded portions, as shown in FIG. 19, in order to use the light from the discharge lamp 2. As shown in FIG. 20, the luminous intensity-improving reflection surfaces 31L and 31R in the radial waveform are formed by shifting a certain point on the reflection surface in the shaded portion in the direction shown by the broken arrow (−n1, −n2, n3), with respect to the normal line (n1, n2, n3) shown by the solid line. In the light distribution pattern shown in FIG. 21, since the left and the right end portions in the 5000-candela zone are located closely to both the left and the right sides at about 22 degrees, the visibility in the traveling direction at the time of cornering can be reliably improved.

The luminous intensity-improving reflection surface forming unit 85 thus forms the luminous intensity-improving reflection surfaces 31L and 31R, which can obtain the light distribution pattern shown in FIG. 21, in the shaded portions of the diffuse reflection surfaces 30L and 30R shown in FIG. 13 (twelfth step S12). The luminous intensity-improving reflection surfaces 31L and 31R correspond to the luminous intensity-improving reflection surface 31L including the wide area-illuminating reflection surface and the diffuse reflection surface 30L in the left segment and the luminous intensity-improving reflection surface 31R including the wide area-illuminating reflection surface and the diffuse reflection surface 30R in the right segment, in the vehicle headlamp and the reflector according to the first to the third embodiments.

As described above, the reflector design program in the embodiment forms the reflection surface of the reflector, by which an intended light distribution pattern can be obtained, based on the reference data (size data of the reference reflector, the quadratic equation for the rational B-spline surface, position data of the light source, data for shifting the control points, a weight in the quadratic equation for the rational B-spline surface, data for increasing the number of control points, and data for shifting the number-increased control points). As a result, the reflector can be manufactured at a cheaper cost.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A projector type vehicle headlamp comprising:

a light source;

a reflector including a reflection surface for reflecting light from the light source; and a condenser lens that irradiates reflected light from the reflection surface forwards, wherein the reflection surface includes a plurality of segments, and is formed of a free-form surface obtained by deforming a reference ellipsoid of revolution, wherein the reflection surface is formed into a free-form surface obtained by stretching the reference ellipsoid of revolution in one direction and pushing down the reference ellipsoid of revolution in other direction perpendicular to the one direction to deform the reference ellipsoid of revolution, the light source is arranged between a first focal point of the reference ellipsoid of revolution and the condenser lens, closer to the first focal point than to the condenser lens, and segments forming one end and other end portions of a light distribution pattern include a wide area-illuminating reflection surface that makes the one end and the other end portions substantially a rectangular shape, wherein the other end portion is opposite to the one end portion with respect to a center of the light distribution pattern.

2. The vehicle headlamp according to claim 1, wherein the segments forming the one end and the other end portions further include a diffuse reflection surface that diffuses edges of the one end and the other end portions formed substantially in a rectangular shape by the wide area-illuminating reflection surfaces.

3. The vehicle headlamp according to claim 1, wherein the segments forming the one end and the other end portions further include a diffuse reflection surface that diffuses edges of the one end and the other end portions formed substantially in a rectangular shape by the wide area-illuminating reflection surfaces, and a portion of the diffuse reflection surface, which is not substantially illuminated by the light from the light source when a predetermined light distribution pattern for a low beam is formed, includes a luminous intensity-improving reflection surface that increases luminous intensity at the one end and the other end portions formed substantially in a rectangular shape by the wide area-illuminating reflection surface.

4. The vehicle headlamp according to claim 1, wherein the reflection surface has a second focal point.

5. A projector type vehicle headlamp comprising:

a light source;

a reflector including a reflection surface for reflecting light from the light source; and a condenser lens that irradiates reflected light from the reflection surface forwards, wherein the reflection surface includes a plurality of segments, and is formed of a free-form surface obtained by deforming a reference ellipsoid of revolution, wherein the reflection surface is formed into a free-form surface obtained by stretching the reference ellipsoid of revolution in one direction and pushing down the reference ellipsoid of revolution in other direction perpendicular to the one direction to deform the reference ellipsoid of revolution, the light source is arranged between a first focal point of the reference ellipsoid of revolution and the condenser lens, closer to the first focal point than to the condenser lens, and segments forming one end and other end portions of a light distribution pattern include a wide area-illuminating reflection surface that makes the one end and the other end portions substantially a rectangular shape, wherein the other end portion is opposite to the one end portion with respect to a center of the light distribution pattern, wherein the reflection surface includes a first continuous segment that forms diffused light at a center portion of the light distribution pattern;

a second continuous segment that forms spotlight at the center portion;

a third segment that forms the one end portion; and a fourth segment that forms the other end portion.

6. A reflector for a projector type vehicle headlamp, comprising:

a reflection surface that reflects light from a light source toward a condenser lens, wherein the reflection surface includes a plurality of segments, and is formed of a free-form surface obtained by deforming a reference ellipsoid of revolution, wherein the reflection surface is formed into a free-form surface obtained by stretching the reference ellipsoid of revolution in one direction and pushing down the reference ellipsoid of revolution in other direction perpendicular to the one direction to deform the reference ellipsoid of revolution, the light source is arranged between a first focal point of the reference ellipsoid of revolution and the condenser lens, closer to the first focal point than to the condenser lens, and segments forming one end and other end portion of a light distribution pattern include a wide area-illuminating reflection surface that makes the one end and the other end portions substantially a rectangular shape, wherein the other end portion is opposite to the one end portion with respect to a center of the light distribution pattern.

7. The reflector according to claim 6, wherein the segments forming the one end and the other end portions further include a diffuse reflection surface that diffuses edges of the one end and the other end portions formed substantially in a rectangular shape by the wide area-illuminating reflection surfaces.

8. The reflector according to claim 6, wherein the segments forming the one end and the other end portions further include a diffuse reflection surface that diffuses edges of the one end and the other end portions formed substantially in a rectangular shape by the wide area-illuminating reflection surfaces, and a portion of the diffuse reflection surface, which is not substantially illuminated by the light from the light source when a predetermined light distribution pattern for a low beam is formed, includes a luminous intensity-improving reflection surface that increases luminous intensity at the one end and the other end portions formed substantially in a rectangular shape by the wide area-illuminating reflection surface.

9. A reflector for a projector type vehicle headlamp, comprising:

a reflection surface that reflects light from a light source toward a condenser lens, wherein the reflection surface includes a plurality of segments, and is formed of a free-form surface obtained by deforming a reference ellipsoid of revolution, wherein the reflection surface is formed into a free-form surface obtained by stretching the reference ellipsoid of revolution in one direction and pushing down the reference ellipsoid of revolution in other direction perpendicular to the one direction to deform the reference ellipsoid of revolution, the light source is arranged between a first focal point of the reference ellipsoid of revolution and the condenser lens, closer to the first focal point than to the condenser lens, and segments forming one end and other end portion of a light distribution pattern include a wide area-illuminating reflection surface that makes the one end and the other end portions substantially a rectangular shape, wherein the other end portion is opposite to the one end portion with respect to a center of the light distribution pattern, wherein the reflection surface includes a first continuous segment that forms diffused light at a center portion of the light distribution pattern;

a second continuous segment that forms spotlight at the center portion;

a third segment that forms the one end portion; and a fourth segment that forms the other end portion.

* * * * *